US007871252B2

(12) United States Patent
Bae et al.

(10) Patent No.: US 7,871,252 B2
(45) Date of Patent: Jan. 18, 2011

(54) ROTARY COMPRESSOR HAVING TWO COMPRESSION CAPACITIES

(75) Inventors: Ji Young Bae, Busan (KR); Kyoung Jun Park, Changwon-si (KR); Chang Yong Jang, Gwangju (KR); Chul Gi Roh, Changwon-si (KR); Jong Bong Kim, Changwon-si (KR); Young Hwan Ko, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1030 days.

(21) Appl. No.: 10/556,346

(22) PCT Filed: Apr. 30, 2004

(86) PCT No.: PCT/KR2004/000999

§ 371 (c)(1),
(2), (4) Date: Jan. 17, 2007

(87) PCT Pub. No.: WO2004/102004

PCT Pub. Date: Nov. 25, 2004

(65) Prior Publication Data

US 2007/0122284 A1 May 31, 2007

(30) Foreign Application Priority Data

May 13, 2003 (KR) ..... 10-2003-0030342

(51) Int. Cl.
*F04C 2/00* (2006.01)
*F04C 28/18* (2006.01)

(52) U.S. Cl. ..... 418/32; 418/11; 418/23; 418/60; 417/218; 417/221

(58) Field of Classification Search ..... 418/32, 418/11, 23, 60, 63, 270; 417/218, 221, 223, 417/212, 315
See application file for complete search history.

(56) References Cited

U.S. PATENT DOCUMENTS 3,723,024 A 3/1973 Sawai
3,985,473 A * 10/1976 King et al. ..... 418/32
4,367,638 A 1/1983 Gray (Continued)

FOREIGN PATENT DOCUMENTS

CN 1118182 A 3/1996

(Continued)

*Primary Examiner*—Theresa Trieu
(74) *Attorney, Agent, or Firm*—Birch, Stewart, Kolasch & Birch, LLP

(57) ABSTRACT

A rotary compressor includes a driving shaft rotatable clockwise and counterclockwise, and an eccentric portion of a predetermined size; a cylinder forming a predetermined inner volume; a roller installed rotatably on an outer circumference of the eccentric portion to contact an inner circumference of the cylinder; a vane installed elastically in the cylinder to contact the roller continuously; a first bearing installed in the cylinder, for supporting the driving shaft rotatably; a second bearing rotatably supporting the driving shaft and preliminarily storing the fluid to be sucked; discharge ports communicating with the fluid chamber; and a valve assembly having openings separated by predetermined angle from each other, wherein compression spaces that have different volumes from each other are formed in the fluid chamber according to the rotation direction of the driving shaft so that two different compression capacities are formed.

50 Claims, 24 Drawing Sheets

U.S. PATENT DOCUMENTS

| | | | |
|---|---|---|---|
| 4,566,869 | A | 1/1986 | Pandeya et al. |
| 4,598,559 | A | 7/1986 | Tomayko et al. |
| 4,702,088 | A | 10/1987 | Ozu |
| 5,522,235 | A | 6/1996 | Fumio et al. |

FOREIGN PATENT DOCUMENTS

| | | | | | |
|---|---|---|---|---|---|
| CN | 1118841 | A | | 3/1996 | |
| JP | 58156194 | U | * | 10/1983 | |
| JP | 60142087 | A | * | 7/1985 | ..... 418/270 |
| JP | 62126290 | A | * | 6/1987 | ..... 418/63 |
| JP | 63032192 | A | * | 2/1988 | ..... 418/63 |
| JP | 63-50693 | A | | 3/1988 | |
| JP | 6-107193 | A | | 4/1994 | |
| JP | 09-254279 | A | | 10/1997 | |

* cited by examiner

ROTARY COMPRESSOR HAVING TWO COMPRESSION CAPACITIES

TECHNICAL FIELD

The present invention relates to a rotary compressor, and more particularly, to a mechanism for changing compression capacity of a rotary compressor.

BACKGROUND ART

In general, compressors are machines that are supplied power from a power generator such as electric motor, turbine or the like and apply compressive work to a working fluid, such as air or refrigerant to elevate the pressure of the working fluid. Such compressors are widely used in a variety of applications, from electric home appliances such as air conditioners, refrigerators and the like to industrial plants.

The compressors are classified into two types according to their compressing methods: a positive displacement compressor, and a dynamic compressor (a turbo compressor). The positive displacement compressor is widely used in industry fields and configured to increase pressure by reducing its volume. The positive displacement compressors can be further classified into a reciprocating compressor and a rotary compressor.

The reciprocating compressor is configured to compress the working fluid using a piston that linearly reciprocates in a cylinder. The reciprocating compressor has an advantage of providing high compression efficiency with a simple structure. However, the reciprocation compressor has a limitation in increasing its rotational speed due to the inertia of the piston and a disadvantage in that a considerable vibration occurs due to the inertial force. The rotary compressor is configured to compress working fluid using a roller eccentrically revolving along an inner circumference of the cylinder, and has an advantage of obtaining high compression efficiency at a low speed compared with the reciprocating compressor, thereby reducing noise and vibration.

Recently, compressors having at least two compression capacities have been developed. These compressors have compression capacities different from each other according to the rotation directions (i.e., clockwise direction and counterclockwise direction) by using a partially modified compression mechanism. Since compression capacity can be adjusted differently according to loads required by these compressors, such a compressor is widely used to increase an operation efficiency of several equipments requiring the compression of working fluid, especially household electric appliances such as a refrigerator that uses a refrigeration cycle.

However, a conventional rotary compressor has separately a suction portion and a discharge portion which communicate with a cylinder. The roller rolls from the suction port to the discharge portion along an inner circumference of the cylinder, so that the working fluid is compressed. Accordingly, when the roller rolls in an opposite direction (i.e., from the discharge portion to the suction portion), the working fluid is not compressed. In other words, the conventional rotary compressor cannot have different compression capacities if the rotation direction is changed. Accordingly, there is a demand for a rotary compressor having variable compression capacities as well as the aforementioned advantages.

DISCLOSURE OF INVENTION

Accordingly, the present invention is directed to a rotary compressor that substantially obviates one or more problems due to limitations and disadvantages of the related art.

An object of the present invention is to provide a rotary compressor in which the compressing stroke is possibly performed to both of the clockwise and counterclockwise rotations of a driving shaft.

Another object of the present invention is to provide a rotary compressor whose compression capacity can be varied.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a rotary compressor comprising: a driving shaft being rotatable clockwise and counterclockwise, and having an eccentric portion of a predetermined size; a cylinder forming a predetermined inner volume; a roller installed rotatably on an outer circumference of the eccentric portion so as to contact an inner circumference of the cylinder, performing a rolling motion along the inner circumference and forming a fluid chamber to suck and compress fluid along with the inner circumference; a vane installed elastically in the cylinder to contact the roller continuously; a first bearing installed in the cylinder, for supporting the driving shaft rotatably; a second bearing for rotatably supporting the driving shaft and preliminarily storing the fluid to be sucked; discharge ports communicating with the fluid chamber; and a valve assembly having openings separated by a predetermined angle from each other, for allowing the openings to selectively communicate with the second bearing at a predetermined position of the fluid chamber according to rotation direction of the driving shaft, wherein compression spaces that have different volumes from each other are formed in the fluid chamber according to the rotation direction of the driving shaft so that two different compression capacities are formed.

According to the present invention described above, two different compression capacities can be obtained according to the rotation direction of the driving shaft.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention to achieve the objects, with examples of which are illustrated in the accompanying drawings. Wherever possible, the same reference numbers will be used throughout the drawings to refer to the same or like parts.

Figure 1:
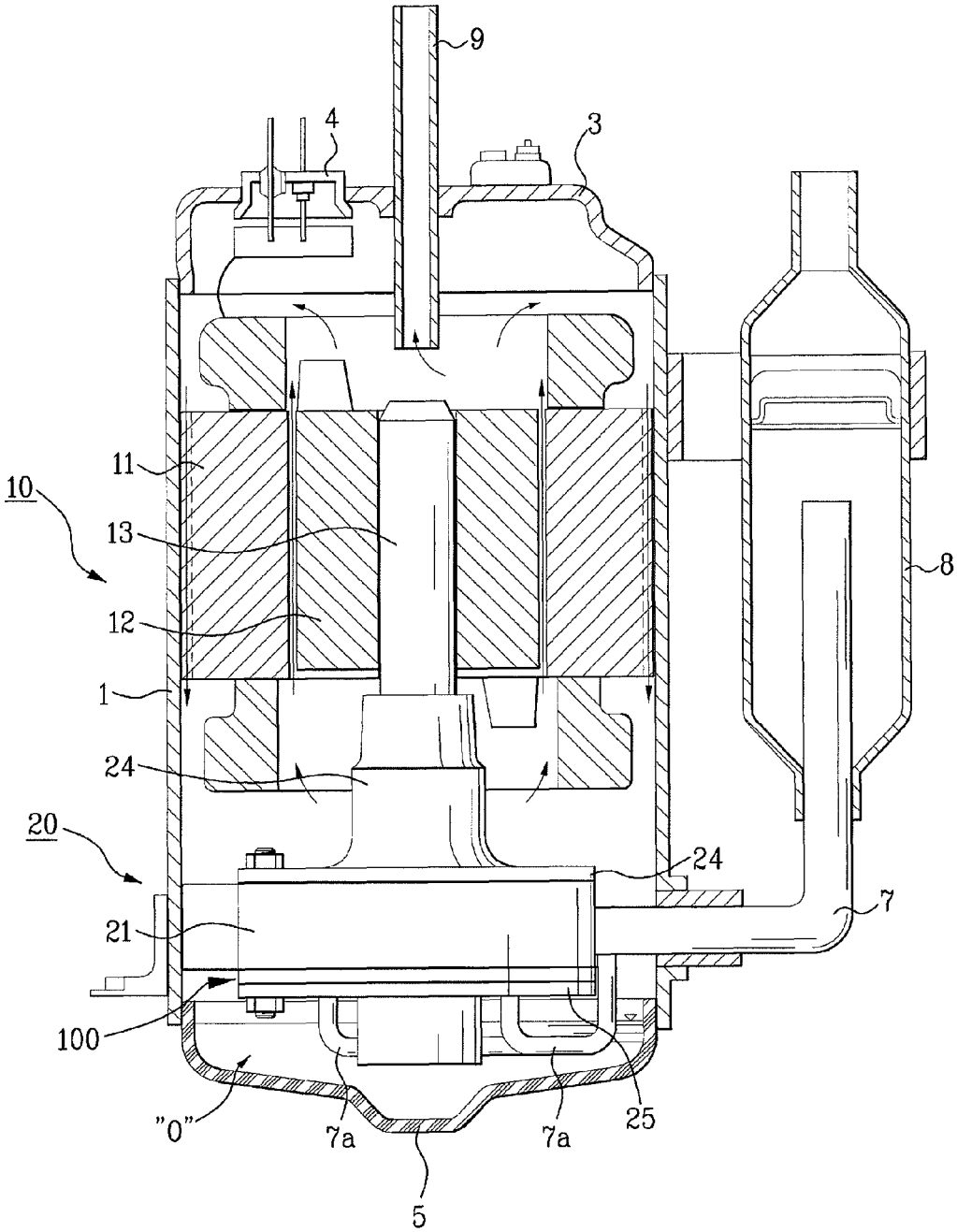
FIG. 1 is a partial longitudinal sectional view illustrating a rotary compressor according to the present invention.
Figure 2:
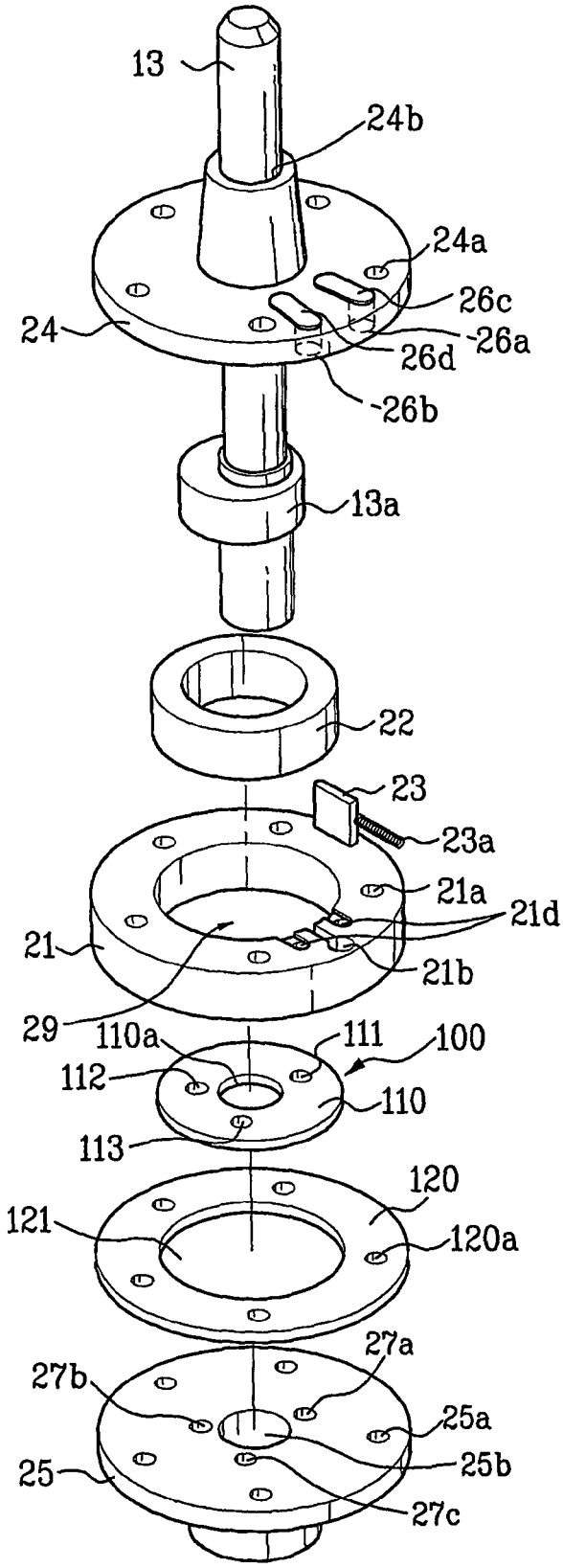
FIG. 2 is an exploded perspective view illustrating a compressing unit of a rotary compressor according to the present invention.

FIG. 1 is a partial longitudinal sectional view illustrating structure of a rotary compressor according to the present invention. FIG. 2 is an exploded perspective view illustrating a compressing unit of a rotary compressor according to the present invention.

FIG. 1 is a partial longitudinal sectional view illustrating structure of a rotary compressor according to the present invention. FIG. 2 is an exploded perspective view illustrating a compressing unit of a rotary compressor according to the present invention.

As shown in FIG. 1, a rotary compressor of the present invention includes a case 1, a power generator 10 positioned in the case 1 and a compressing unit 20. Referring to FIG. 1, the power generator 10 is positioned on the upper portion of the rotary compressor and the compressing unit 20 is positioned on the lower portion of the rotary compressor. However, their positions may be changed if necessary. An upper cap 3 and a lower cap 5 are installed on the upper portion and the lower portion of the case 1 respectively to define a sealed inner space. A suction pipe 7 for sucking working fluid is installed on a side of the case 1 and connected to an accumulator 8 for separating lubricant from refrigerant. A discharge tube 9 for discharging the compressed fluid is installed on the center of the upper cap 3. A predetermined amount of the lubricant "0" is filled in the lower cap 5 so as to lubricate and cool members that are moving frictionally. Here, an end of a driving shaft 13 is dipped in the lubricant.

The power generator 10 includes a stator 11 fixed in the case 1, a rotor 12 rotatable supported in the stator 11 and the driving shaft 13 inserted forcibly into the rotor 12. The rotor 12 is rotated due to electromagnetic force, and the driving shaft 13 delivers the rotation force of the rotor to the compressing unit 20. To supply external power to the stator 20, a terminal 4 is installed in the upper cap 3.

The compressing unit 20 includes a cylinder 21 fixed to the case 1, a roller 22 positioned in the cylinder 21 and first and second bearings 24 and 25 respectively installed on first and second portions of the cylinder 21. The compressing unit 20 also includes a valve assembly 100 installed between the second bearing 25 and the cylinder 21. The compressing unit 20 will be described in more detail with reference to FIGS. 2, 3 and 4.

The cylinder 21 has a predetermined inner volume and a strength enough to endure the pressure of the fluid. The cylinder 21 accommodates an eccentric portion 13*a* formed on the driving shaft 13 in the inner volume. The eccentric portion 13*a* is a kind of an eccentric cam and has a center spaced by a predetermined distance from its rotation center. The cylinder 21 has a groove 21*b* extending by a predetermined depth from its inner circumference. A vane 23 to be described below is installed on the groove 21*b*. The groove 21*b* is long enough to accommodate the vane 23 completely.

Figure 4:
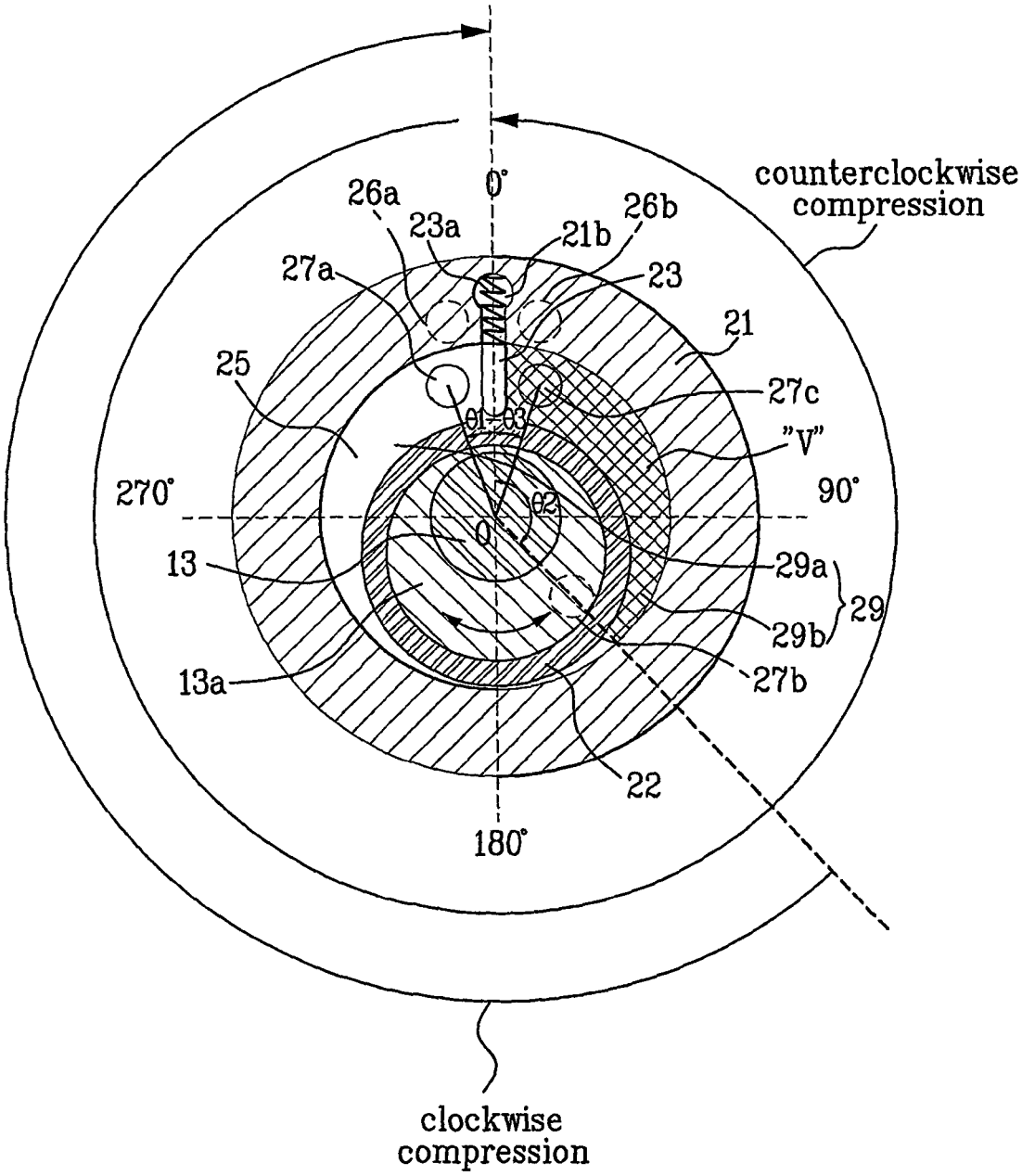
FIG. 4 is a cross-sectional view illustrating a cylinder of a rotary compressor according to the present invention.

The roller 22 is a ring member that has an outer diameter less than the inner diameter of the cylinder 21. As shown in FIG. 4, the roller 22 contacts the inner circumference of the cylinder 21 and rotatably coupled with the eccentric portion 13*a*. Accordingly, the roller 22 performs rolling motion on the inner circumference of the cylinder 21 while spinning on the outer circumference of the eccentric portion 13*a* when the driving shaft 13 rotates. The roller 22 revolves spaced apart by a predetermined distance from the rotation center '0' due to the eccentric portion 13*a* while performing the rolling motion. Since the outer circumference of the roller 22 always contacts the inner circumference due to the eccentric portion 13*a*, the outer circumference of the roller 22 and the inner circumference of the cylinder form a separate fluid chamber 29 in the inner volume. The fluid chamber 29 is used to suck and compress the fluid in the rotary compressor.

The vane 23 is installed in the groove 21*b* of the cylinder 21 as described above. An elastic member 23*a* is installed in the groove 21*b* to elastically support the vane 23. The vane 23 continuously contacts the roller 22. In other words, the elastic member 23*a* has one end fixed to the cylinder 21 and the other end coupled with the vane 23, and pushes the vane 23 to the side of the roller 22. Accordingly, the vane 23 divides the fluid chamber 29 into two separate spaces 29*a* and 29*b* as shown in FIG. 4. While the driving shaft 13 rotate or the roller 22 revolves, the volumes of the spaces 29*a* and 29*b* change complementarily. In other words, if the roller 22 rotates clockwise, the space 29*a* gets smaller but the other space 29*b* gets larger. However, the total volume of the spaces 29*a* and 29*b* is constant and approximately same as that of the predetermined fluid chamber 29. One of the spaces 29*a* and 29*b* works as a suction chamber for sucking the fluid and the other one works as a compression chamber for compressing the fluid relatively when the driving shaft 13 rotates in one direction (clockwise or counterclockwise). Accordingly, as described above, the compression chamber of the spaces 29*a* and 29*b* gets smaller to compress the previously sucked fluid and the suction chamber expands to suck the new fluid relatively according to the rotation of the roller 22. If the rotation direction of the roller 22 is reversed, the functions of the spaces 29*a* and 29*b* are exchanged. In the other words, if the roller 22 revolves counterclockwise, the right space 29*b* of the roller 22 becomes a compression chamber, but if the roller 22 revolves clockwise, the left space 29*a* of the roller 22 becomes a discharge unit.

The first bearing 24 and the second bearing 25 are, as shown in FIG. 2, installed on the upper and lower portions of the cylinder 21 respectively, and rotatably support the driving shaft 12 using a sleeve and the penetrating holes 24*b* and 25*b* formed inside the sleeve. More particularly, the first bearing 24, the second bearing 25 and the cylinder 21 include a plurality of coupling holes 24*a*, 25*a* and 21*a* formed to correspond to each other respectively. The cylinder 21, the first bearing 24 and the second bearing 25 are coupled with one another to seal the cylinder inner volume, especially the fluid chamber 29 using coupling members such as bolts and nuts. The discharge ports 26*a* and 26*b* are formed on the first bearing 24. The discharge ports 26*a* and 26*b* communicate with the fluid chamber 29 so that the compressed fluid can be discharged. The discharge ports 26*a* and 26*b* can communicate directly with the fluid chamber 29 or can communicate with the fluid chamber 29 through a predetermined fluid passage 21*d* formed in the cylinder 21 and the first bearing 24. Discharge valves 26*c* and 26*d* are installed on the first bearing 24 so as to open and close the discharge ports 26*a* and 26*b*. The discharge valves 26*c* and 26*d* selectively open the discharge ports 26*a* and 26*b* only when the pressure of the chamber 29 is greater than or equal to a predetermined pressure. To achieve this, it is desirable that the discharge valves 26*c* and 26*d* are leaf springs of which one end is fixed in the vicinity of the discharge ports 26 and 26*b* and the other end can be deformed freely. Although not shown in the drawings, a retainer for limiting the deformable amount of the leaf spring may be installed on the upper portion of the discharge valves 26*c* and 26*d* so that the valves can operate stably. In addition, a muffler (not shown) can be installed on the upper portion of the first bearing 24 to reduce a noise generated when the compressed fluid is discharged.

The suction ports 27*a*, 27*b* and 27*c* communicating with the fluid chamber 29 are formed on the second bearing 25. The suction ports 27*a*, 27*b* and 27*c* guide the compressed fluid to the fluid chamber 29. The suction ports 27*a*, 27*b* and 27*c* are connected to the suction pipe 7 so that the fluid outside of the compressor can flow into the chamber 29. More particularly, the suction pipe 7 is branched into a plurality of auxiliary tubes 7*a* and is connected to suction ports 27 respectively. If necessary, the discharge ports 26*a*, and 26*b* may be formed on the second bearing 25 and the suction ports 27*a*, 27*b* and 27*c* may be formed on the first bearing 24.

The suction and discharge ports 26 and 27 become the important factors in determining compression capacity of the rotary compressor and will be described referring to FIGS. 4 and 5. FIG. 4 illustrates a cylinder coupled with the second bearing 25 without a valve assembly 100 to show the suction ports 27.

First, the compressor of the present invention includes at least two discharge ports 26*a* and 26*b*. As shown in the drawing, even if the roller 22 revolves in any direction, a discharge port should exist between the suction port and vane 23 positioned in the revolution path to discharge the compressed fluid. Accordingly, one discharge port is necessary for each rotation direction. It causes the compressor of the present invention to discharge the fluid independent of the revolution direction of the roller 22 (that is, the rotation direction of the driving shaft 13). Meanwhile, as described above, the compression chamber of the spaces 29*a* and 29*b* gets smaller to compress the fluid as the roller 22 approaches the vane 23. Accordingly, the discharge ports 26*a* and 26*b* are preferably formed facing each other in the vicinity of the vane 23 to discharge the maximum compressed fluid. In other word, as shown in the drawings, the discharge ports 26*a* and 26*b* are positioned on both sides of the vane 23 respectively. The discharge ports 26*a* and 26*b* are preferably positioned in the vicinity of the vane 23 if possible.

The suction port 27 is positioned properly so that the fluid can be compressed between the discharge ports 26*a* and 26*b* and the roller 22. Actually, the fluid is compressed from a suction port to a discharge port positioned in the revolution path of the roller 22. In other words, the relative position of the suction port for the corresponding discharge port determines the compression capacity and accordingly two compression capacities can be obtained using different suction ports 27 according to the rotation direction. Accordingly, the compression of the present invention has first and second suction ports 27*a* and 27*b* corresponding to two discharge ports 26*a* and 26*b* respectively and the suction ports are separated by a predetermined angle from each other with respect to the center 0 for two different compression capacities.

Figure 5A:
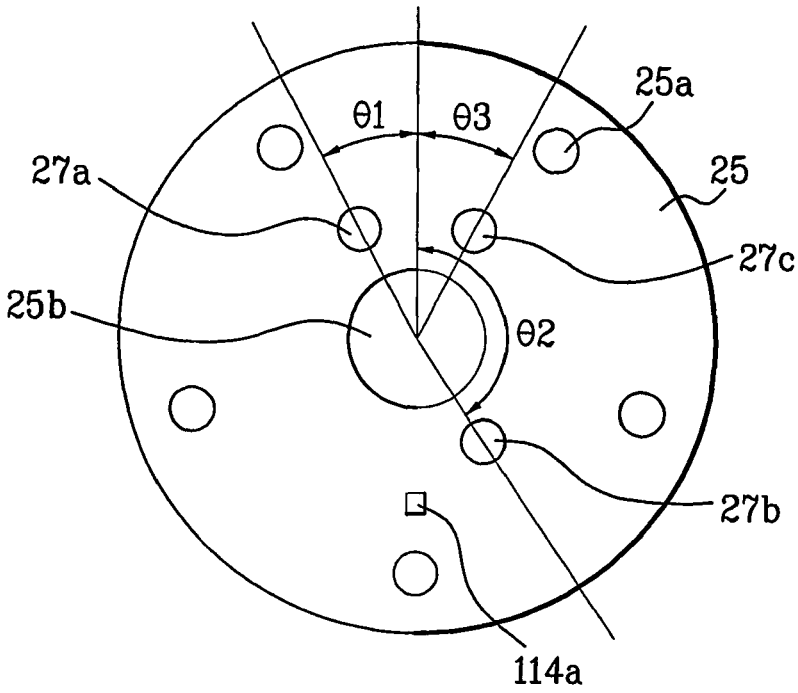
FIGS. 5A and 5B are plan view illustrating a second bearing of a rotary compressor according to the present invention.

Desirably, the first suction port 27*a* is positioned in the vicinity of the vane 23. Accordingly, the roller 22 compresses the fluid from the first suction port 27*a* to the second discharge port 26*b* positioned across the vane 23 in its rotation in one direction (counterclockwise in the drawing). The roller 22 compress the fluid due to the first suction port 27*a* by using the overall chamber 29 and accordingly the compressor has a maximum compression capacity in the counterclockwise rotation. In other words, the fluid as much as overall volume of the chamber 29 is compressed. The first suction port 27*a* is actually separated by an angle θ1 of 10° clockwise or counterclockwise from the vane 23 as shown in FIGS. 4 and 5A. The drawings of the present invention illustrates the first suction port 27*a* separated by the angle θ1 counterclockwise. At this separating angle θ1, the overall fluid chamber 29 can be used to compress the fluid without interference of the vane 23.

The second suction port 27*b* is separated by a predetermined angle from the first suction port 27*a* with respect to the center. The roller 20 compresses the fluid from the second suction port 27*b* to the first discharge port 26*a* in its rotation in counterclockwise direction. Since the second suction port 27*b* is separated by a considerable angle clockwise from the vane 23, the roller 22 compresses the fluid by using a portion of the chamber 29 and accordingly the compressor has the less compression capacity than that of counterclockwise rotary motion. In other words, the fluid as much as a portion volume of the chamber 29 is compressed. The second suction port 27*b* is preferably separated by an angle θ2 of a range of 90-180° clockwise or counterclockwise from the vane 23.

The second suction port 27*b* is preferably positioned facing the first suction port 27*a* so that the difference between compression capacities can be made properly and the interference can be avoid for each rotation direction.

Figure 5B:
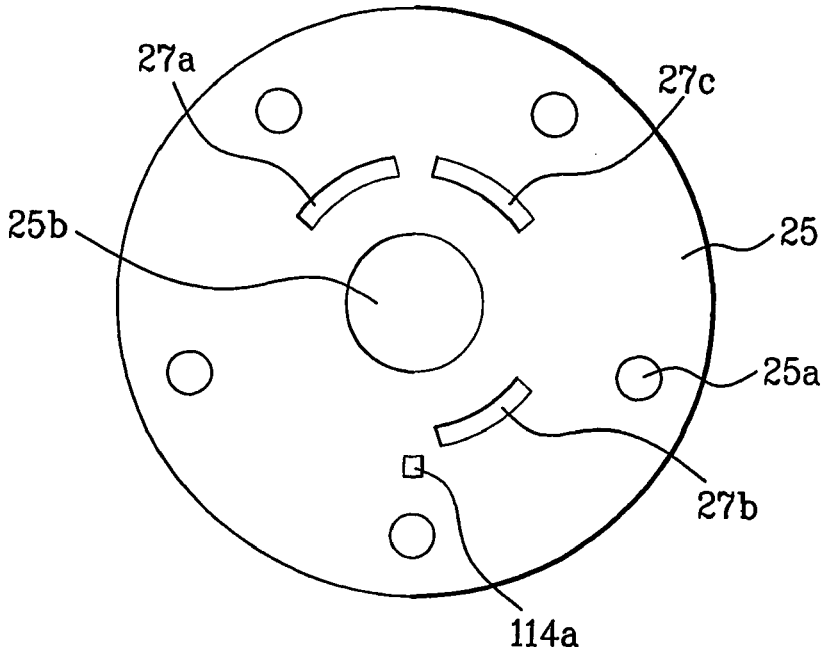

As shown in FIG. 5A, the suction ports 27*a* and 27*b* are generally in circular shapes whose diameters are, preferably, 6-15 mm. In order to increase a suction amount of fluid, the suction ports 27*a* and 27*b* can also be provided in several shapes, including a rectangle. Further, as shown in FIG. 5B, the suction ports 27*a* and 27*b* can be in rectangular shapes having predetermined curvature. In this case, an interference with adjacent other parts, especially the roller 22, can be minimized in operation.

Meanwhile, in order to obtain desired compression capacity in each rotation direction, suction ports that are available in any one of rotation directions should be single. If there are two suction ports in rotation path of the roller 22, the compression does not occur between the suction ports. In other words, if the first suction port 27*a* is opened, the second suction port 27*b* should be closed, and vice versa. Accordingly, for the purpose of electively opening only one of the suction ports 27*a* and 27*b* according to the revolution direction of the roller 22, the valve assembly 100 is installed in the compressor of the present invention.

Figure 3:
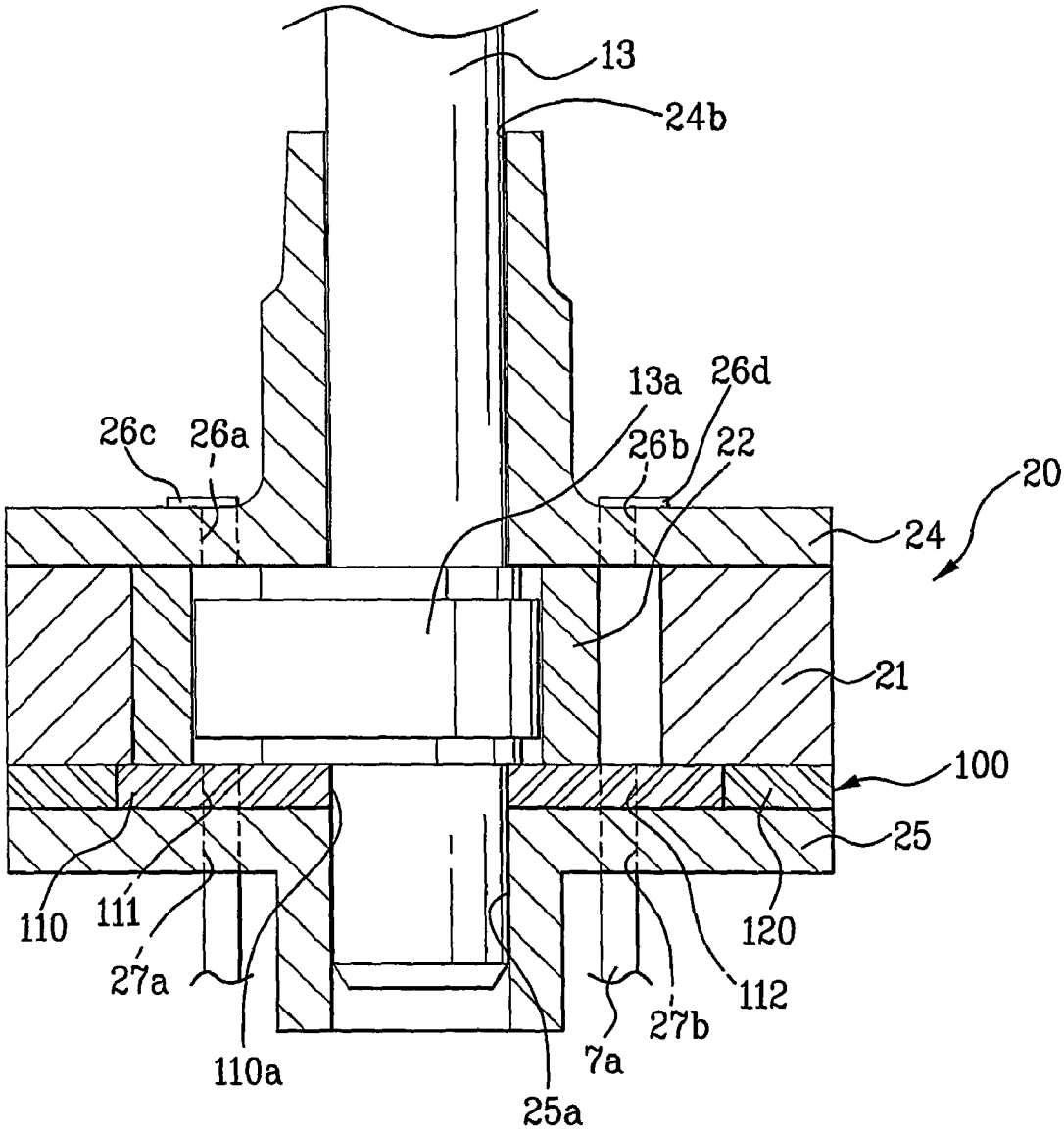
FIG. 3 is a cross-sectional view illustrating a compressing unit of a rotary compressor according to the present invention.
Figure 6:
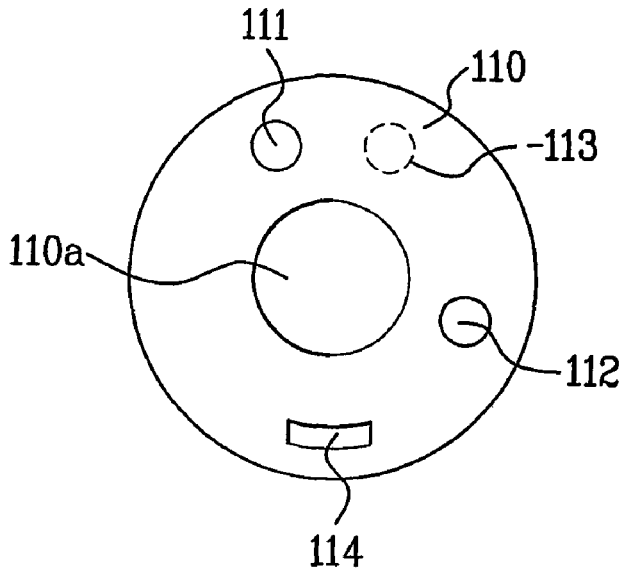
FIG. 6 is a plan view illustrating a valve assembly of a rotary compressor according to the present invention.
Figure 6:
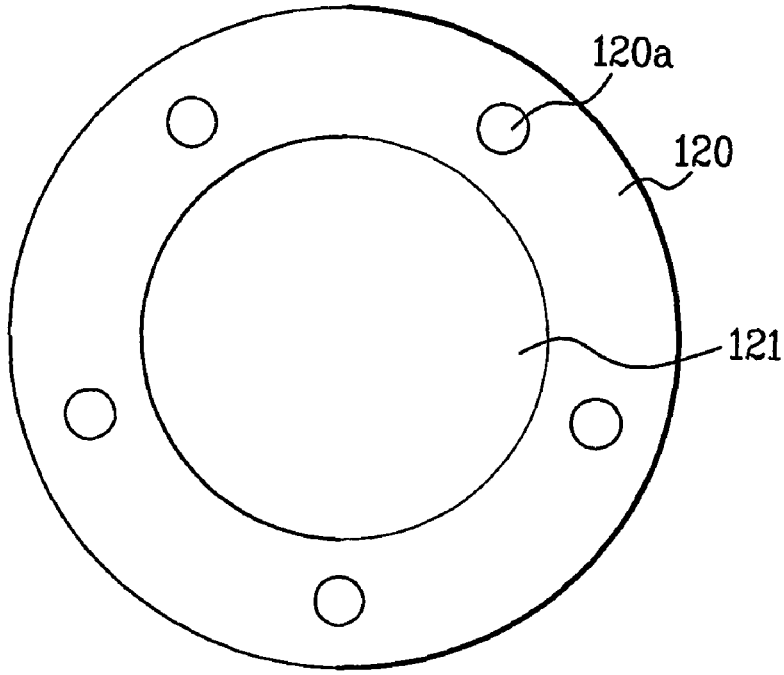

As shown in FIGS. 2, 3 and 6, the valve assembly 100 includes first and second valves 110 and 120, which are installed between the cylinder 21 and the second bearing 25 so as to allow it to be adjacent to the suction ports. If the suction ports 27*a*, 27*b* and 27*c* are formed on the first bearing 24, the first and second valves 110 and 120 are installed between the cylinder 21 and the first bearing 24.

The first valve 110, as shown in FIG. 3, is a disk member installed so as to contact the eccentric portion 13*a* more accurately than the driving shaft 13. Accordingly, if the driving shaft 13 rotates (that is, the roller 22 revolves), the first valve 110 rotates in the same direction. Preferably, the first valve 110 has a diameter larger than an inner diameter of the cylinder 21. As shown in FIG. 3, the cylinder 21 supports a portion (i.e., an outer circumference) of the first valve 110 so that the first valve 110 can rotate stably. Preferably, the first valve 110 is 0.5-5 mm thick.

Figure 7A:
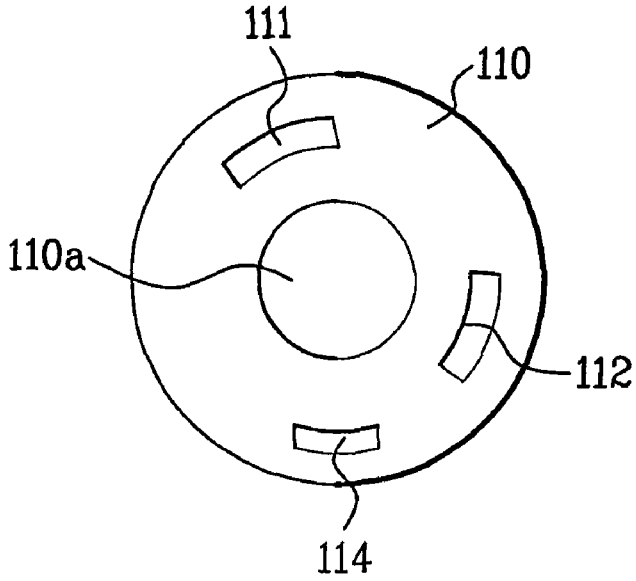
FIGS. 7A and 7C are plan views of modified examples illustrating a valve assembly.
Figure 7B:
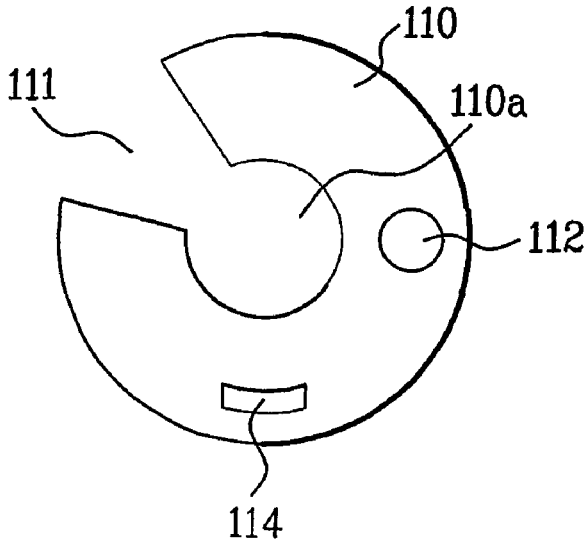
Figure 7C:
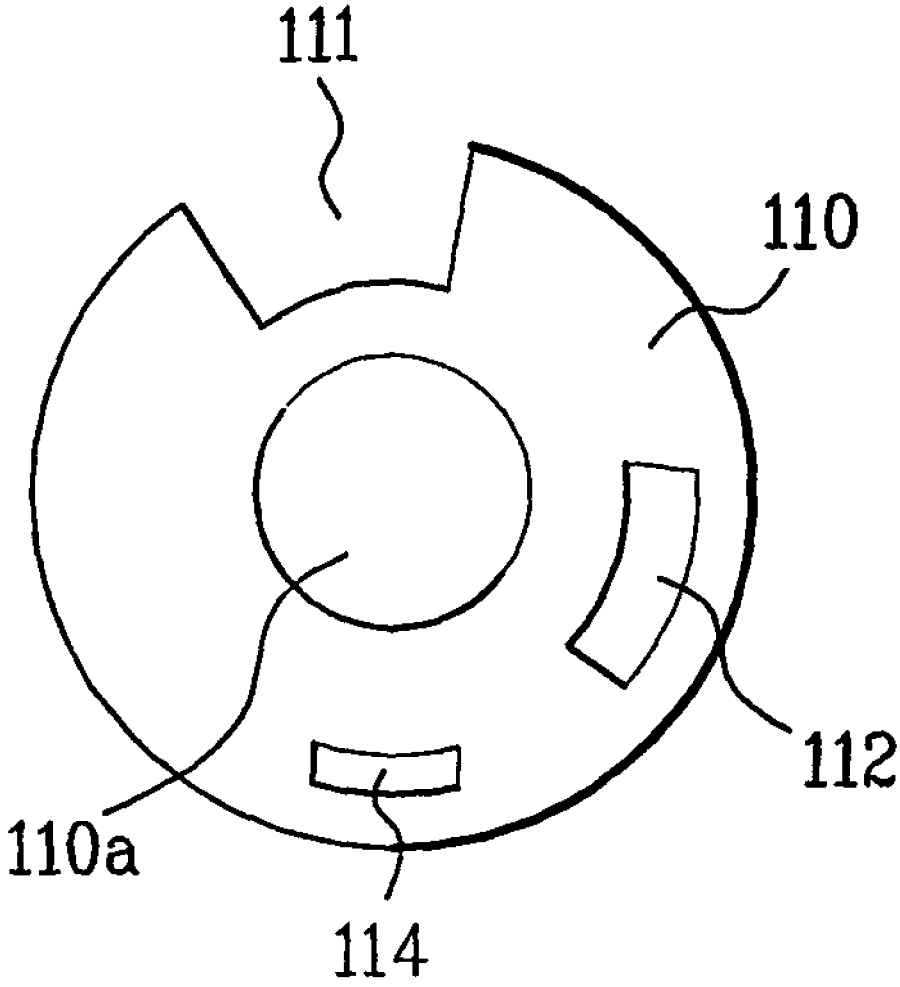

Referring to FIGS. 2 and 6, the first valve 110 includes first and second openings 111 and 112 respectively communicating with the first and second suction ports 27*a* and 27*b* in specific rotation direction, and a penetration hole 110*a* into which the driving shaft 13 is inserted. In more detail, when the roller 22 rotates in any one of the clockwise and counterclockwise directions, the first opening 111 communicates with the first suction port 27*a* by the rotation of the first valve 110, and the second suction port 27*b* is closed by the body of the first valve 110. When the roller 22 rotates in the other of the clockwise and counterclockwise directions, the second opening 112 communicates with the second suction port 27*b*. At this time, the first suction port 27*a* is closed by the body of the first valve 110. These first and second openings 111 and 112 can be in circular or polygonal shapes. In case the openings 111 and 112 are the circular shapes, it is desired that the openings 111 and 112 are 6-15 mm in diameter. Additionally, the openings 111 and 112 can be rectangular shapes having predetermined curvature as shown in FIG. 7A, or cut-away portions as shown in FIG. 7B. As a result, the openings are enlarged, such that fluid is sucked smoothly. If these openings 111 and 112 are formed adjacent to a center of the first valve 110, a probability of interference between the roller 22 and the eccentric portion 13*a* becomes increasing. In addition, there is the fluid's probability of leaking out along the driving shaft 13, since the openings 111 and 112 communicate with a space between the roller 22 and the eccentric portion 13*a*. For these reasons, as shown in FIG. 7C, it is preferable that the openings 111 and 112 are positioned in the vicinity of the outer circumference of the first valve. Meanwhile, the first opening 111 may open each of the first and second suction ports 27*a* and 27*b* at each rotation direction by adjusting the rotation angle of the first valve 110. In other words, when the driving shaft 13 rotates in any one of the clockwise and counterclockwise directions, the first opening 111 communicates with the first suction port 27*a* while closing the second suction port 27*b*. When the driving shaft 13 rotates in the other of the clockwise and counterclockwise directions, the first opening 111 communicates with the second suction port 27*b* while closing the first suction port 27*a*. It is desirable to control the suction ports using such a single opening 111, since the structure of the first valve 110 is simplified much more.

Referring to FIGS. 2, 3 and 6, the second valve 120 is fixed between the cylinder 21 and the second bearing 25 so as to guide a rotary motion of the first valve 110. The second valve 120 is a ring-shaped member having a site portion 121 which receives rotatably the first valve 110. The second valve 120 further includes a coupling hole 120*a* through which it is coupled with the cylinder 21 and the first and second bearings 24 and 25 by a coupling member. Preferably, the second valve 120 has the same thickness as the first valve 110 in order for a prevention of fluid leakage and a stable support. In addition, since the first valve 110 is partially supported by the cylinder 21, the first valve 110 may have a thickness slightly smaller than the second valve 120 in order to form a gap for the smooth rotation of the second valve 120.

Meanwhile, referring to FIG. 4, in the case of the clockwise rotation, the fluid's suction or discharge between the vane 23 and the roller 22 does not occur while the roller 22 revolves from the vane 23 to the second suction port 27*b*. Accordingly, a region V becomes a vacuum state. The vacuum region V causes a power loss of the driving shaft 13 and a loud noise. Accordingly, in order to overcome the problem in the vacuum region V, a third suction port 27*c* is provided at the second bearing 25. The third suction port 27*c* is formed between the second suction port 27*b* and the vane 23, supplying fluid to the space between the roller 22 and the vane 23 so as not to form the vacuum state before the roller 22 passes through the second suction port 27*b*. Preferably, the third suction port 27*c* is formed in the vicinity of the vane 23 so as to remove quickly the vacuum state. However, the third suction port 27*c* is positioned to face the first suction port 27*a* since the third suction port 27*c* operates at a different rotation direction from the first suction port 27*a*. In reality, the third suction port 27*c* is positioned spaced by an angle (θ3) of approximately 10° from the vane 23 clockwise or counterclockwise. In addition, as shown in FIGS. 5A and 5B, the third suction port 27*c* can be circular shapes or curved rectangular shapes.

Since such a third suction port 27*c* operates along with the second suction port 27*b*, the suction ports 27*b* and 27*c* should be simultaneously opened while the roller 22 revolves in any one of the clockwise and counterclockwise directions. Accordingly, the first valve 110 further includes a third opening configured to communicate with the third suction port 27*c* at the same time when the second suction port 27*b* is opened. According to the present invention, the third opening 113 can be formed independently, which is represented with a dotted line in FIG. 6A. However, since the first and third suction ports 27*a* and 27*c* are adjacent to each other, it is desirable to open both the first and third suction ports 27*a* and 27*c* according to the rotation direction of the first opening 111 by increasing the rotation angle of the first valve 110.

The first valve 110 may open the suction ports 27*a*, 27*b* and 27*c* according to the rotation direction of the roller 22, but the corresponding suction ports should be opened accurately in order to obtain desired compression capacity. The accurate opening of the suction ports can be achieved by controlling the rotation angle of the first valve. Thus, preferably, the valve assembly 100 further includes means for controlling the rotation angle of the first valve 110, which will be described in detail with reference to FIGS. 8 to 11. FIGS. 8 to 11 illustrate the valve assembly connected with the second bearing 25 in order to clearly explain the control means.

Figure 8A:
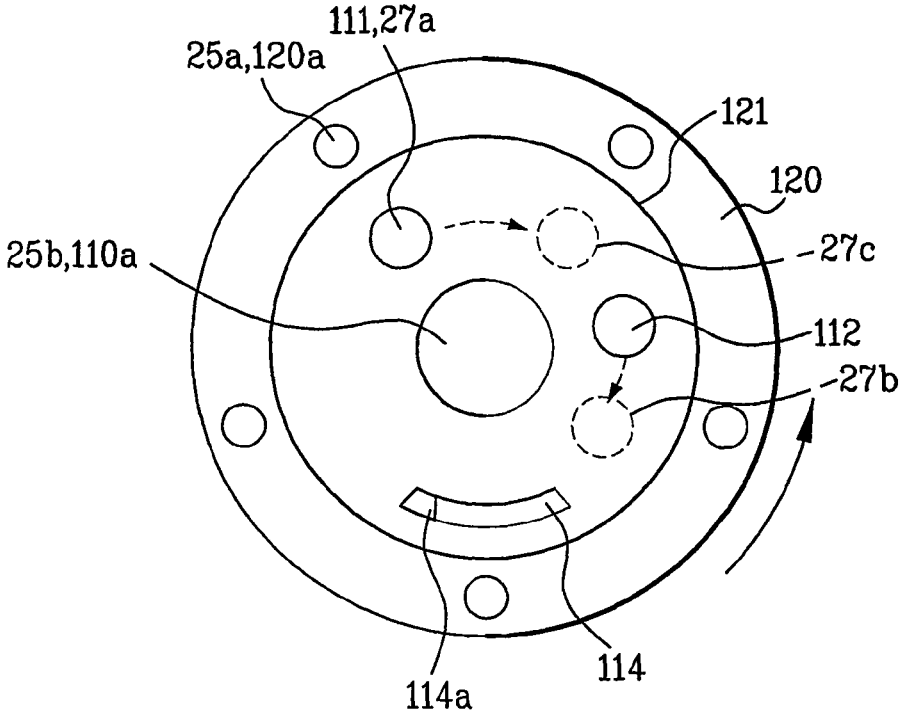
FIGS. 8A and 8B are plan views illustrating a revolution control means.
Figure 8B:
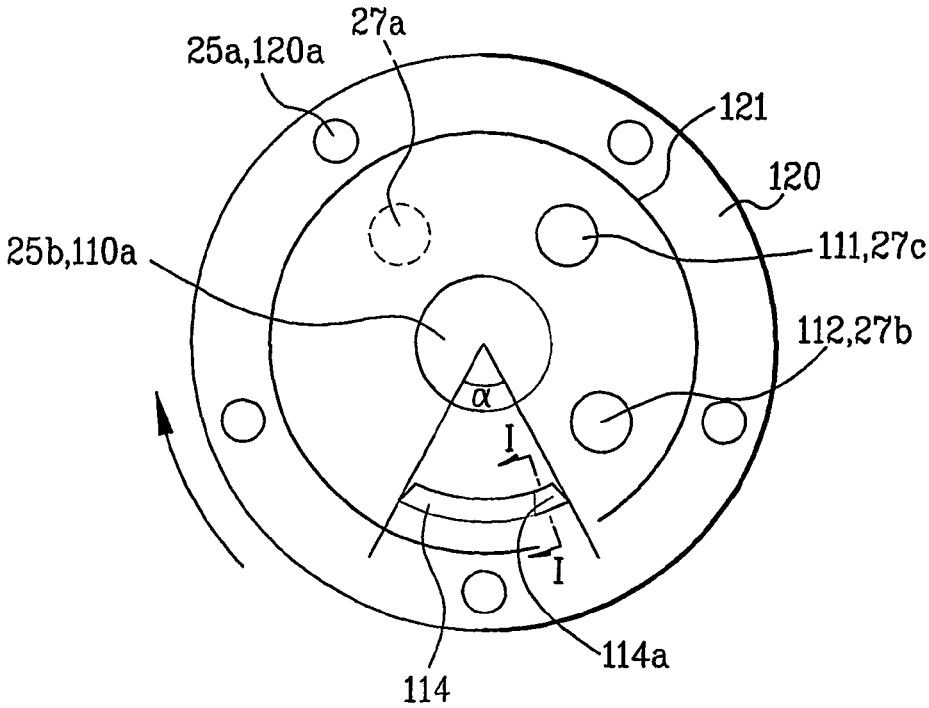
Figure 8C:
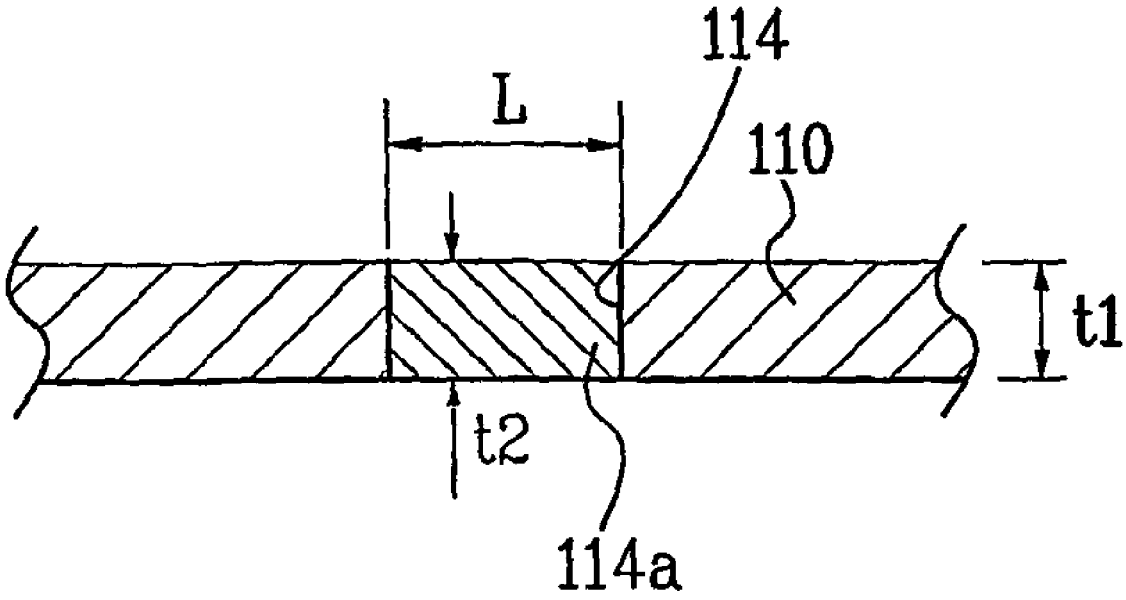
FIG. 8C is a partial cross-sectional view of FIG. 8B.

As shown in FIGS. 8A and 8B, the control means includes a groove 114 formed at the first valve and having a predetermined length, and a stopper 114*a* formed on the second bearing 25 and inserted into the groove 114. The groove 114 and the stopper 114*a* are illustrated in FIGS. 5A, 5B and 6. The groove 114 serves as locus of the stopper 114*a* and can be a straight groove or a curved groove. If the groove 114 is exposed to the chamber 29 during operation, it becomes a dead volume causing a re-expansion of fluid. Accordingly, it is desirable to make the groove 114 adjacent to a center of the first valve 110 so that large portion of the groove 114 can be covered by the revolving roller 22. Preferably, an angle ($\alpha$) between both ends of the groove 114 is of 30-120° in the center of the first valve 110. In addition, if the stopper 114*a* is protruded from the groove 114, it is interfered with the roller 22. Accordingly, it is desirable that a thickness T2 of the stopper 114*a* is equal to a thickness T1 of the valve 110, as shown in FIG. 8C. Preferably, a width L of the stopper 114*a* is equal to a width of the groove 114, such that the first valve rotates stably.

In the case of using the control means, the first valve 110 rotates counterclockwise together with the eccentric portion 13*a* of the driving shaft when the driving shaft 13 rotates counterclockwise. As shown in FIG. 8A, the stopper 114*a* is then latched to one end of the groove 114 to thereby stop the first valve 10. At this time, the first opening 111 accurately communicates with the first suction port 27*a*, and the second and third suction ports 27*b* and 27*c* are closed. As a result, fluid is introduced into the cylinder through the first suction port 27*a* and the first opening 111, which communicate with each other. On the contrary, if the driving shaft 13 rotates clockwise, the first valve 110 also rotates clockwise. At the same time, the first and second openings 111 and 112 also rotate clockwise, as represented with a dotted arrow in FIG. 8A. As shown in FIG. 8B, if the stopper 114*a* is latched to the other end of the groove 114, the first and second openings 111 and 112 are opened together with the third and second suction ports 27*c* and 27*b*. Then, the first suction port 27*a* is closed by the first valve 110. Accordingly, fluid is introduced through the second suction port 27*b*/the second opening 112 and the third suction port 27*c*/the first opening 111, which communicate with each other.

Figure 9A:
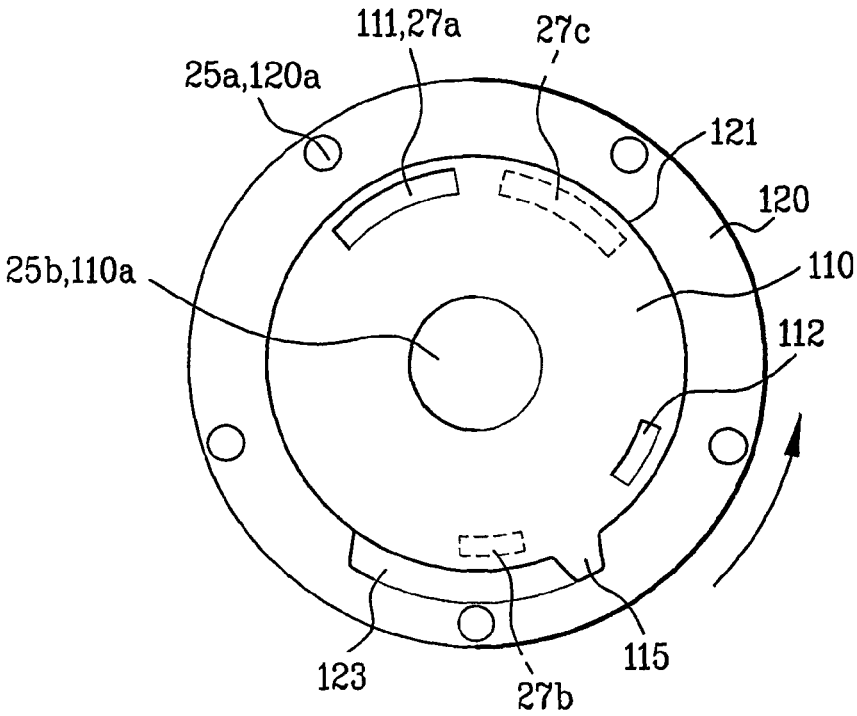
FIGS. 9A and 9B are plan views of modified examples illustrating a revolution control means.
Figure 9B:
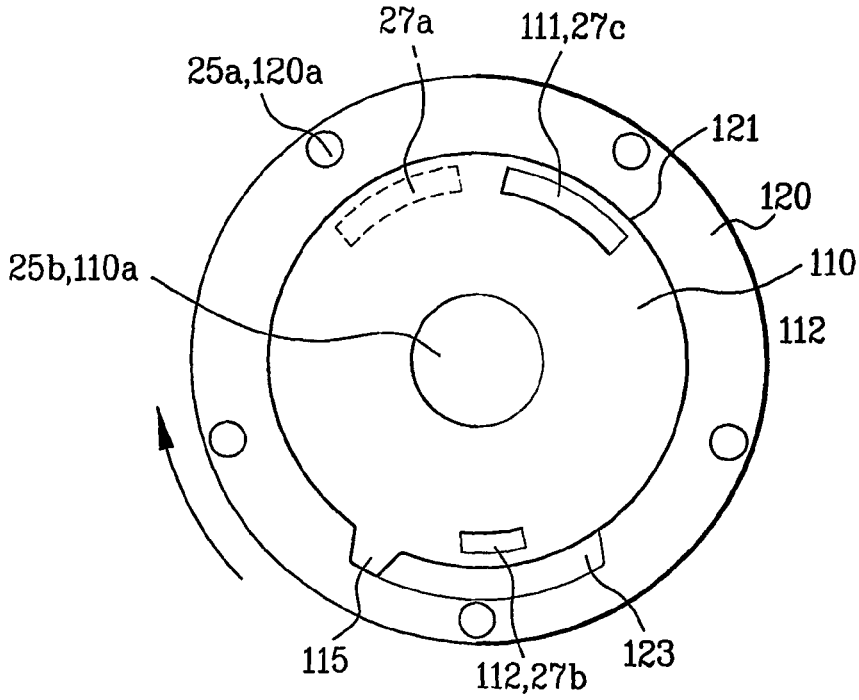

As shown in FIGS. 9A and 9B, the control means can be provided with a projection 115 formed on the first valve 110 and projecting in a radial direction of the first valve, and a groove 123 formed on the second valve 120 and receiving the projection movably. Here, the groove 123 is formed on the second valve 120 so that it is not exposed to the inner volume of the cylinder 21. Therefore, a dead volume is not formed inside the cylinder. In addition, as shown in FIGS. 10A and 10B, the control means can be provided with a projection 124 formed on the second valve 120 and projecting in a radial direction of the second valve 120, and a groove 116 formed on the first valve 110 and receiving the projection 124 movably.

Figure 10A:
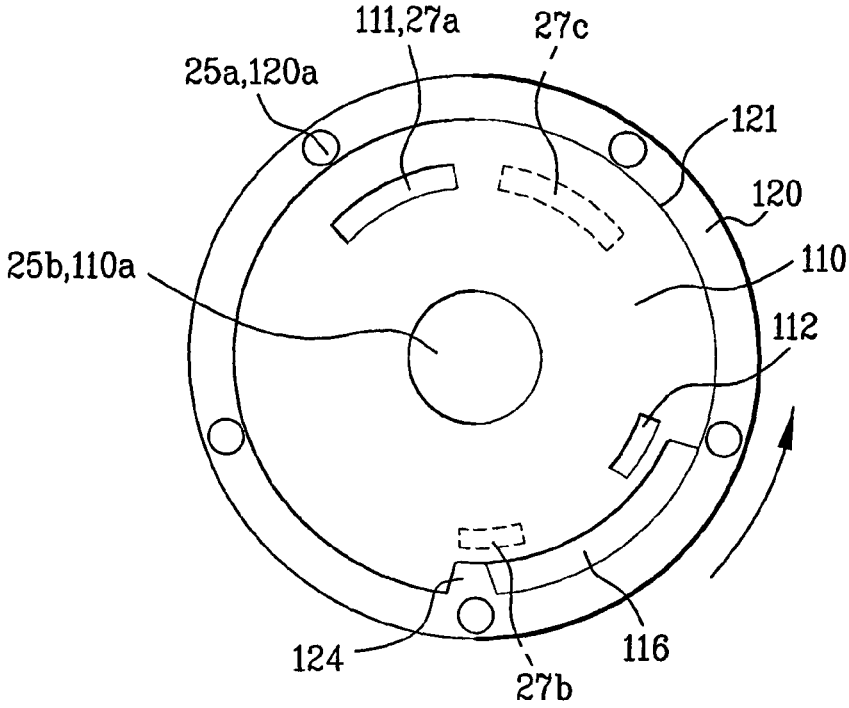
FIGS. 10A and 10B are plan views of another modified examples illustrating a revolution control means.
Figure 10B:
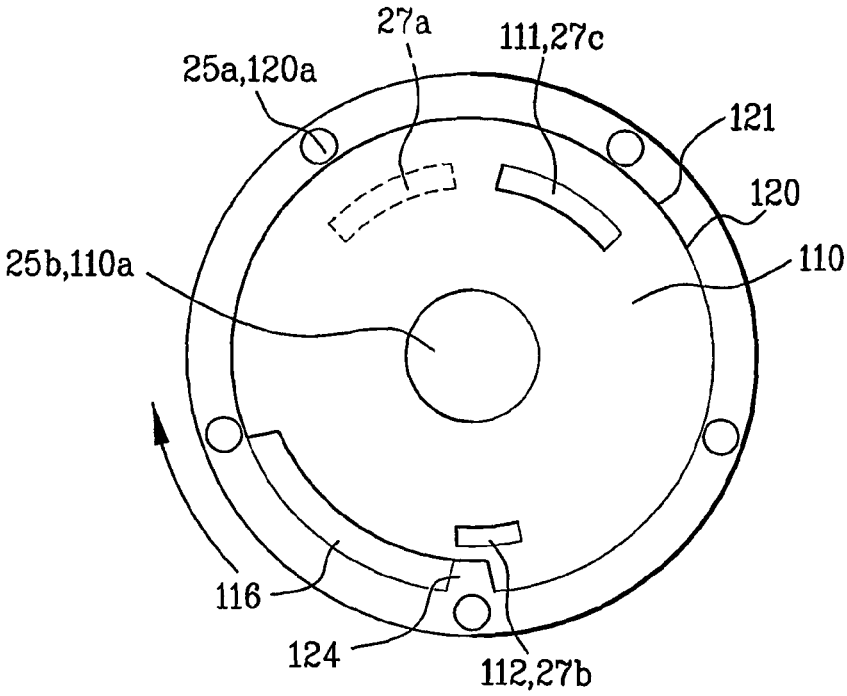

In the case of using such a control means, as shown in FIGS. 9A and 10A, the projections 115 and 124 are latched to one end of each groove 123 and 116 if the driving shaft 13 rotates counterclockwise. Accordingly, the first opening 111 communicates with the first suction port 27*a* so as to allow the suction of fluid, and the second and third suction ports 27*b* and 27*c* are closed. On the contrary, as shown in FIGS. 9B and 10B, if the driving shaft 13 rotates clockwise, the projections 115 and 124 are latched to the other end of each groove 123 and 116, and the first and second openings 11 and 112 simultaneously open the third and second suction ports 27*c* and 27*b* so as to allow the suction of fluid. The first suction port 27*a* is closed by the first valve 110.

Figure 11A:
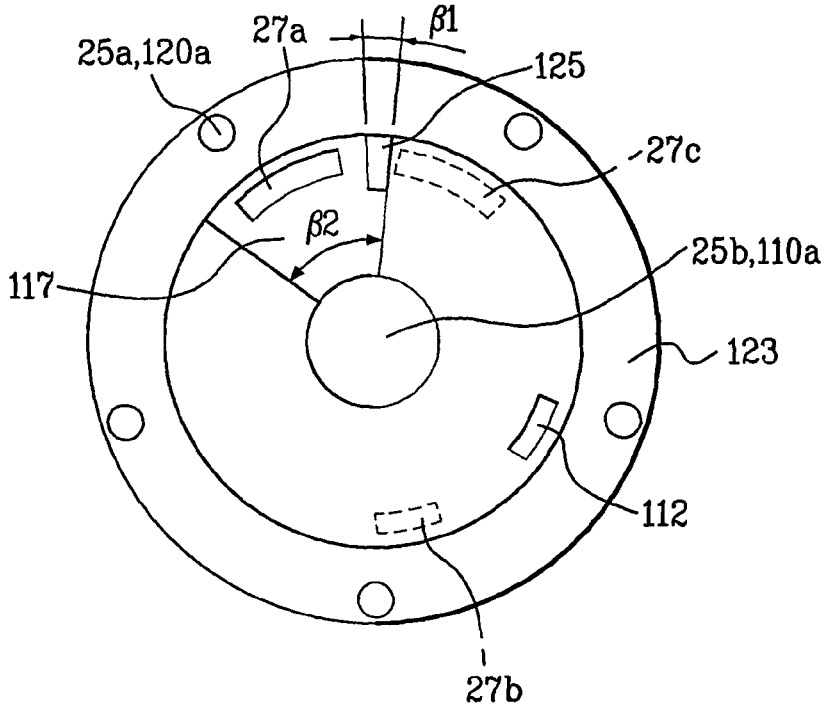
FIGS. 11A and 11B are plan views of another modified examples illustrating a revolution control means.
Figure 11B:
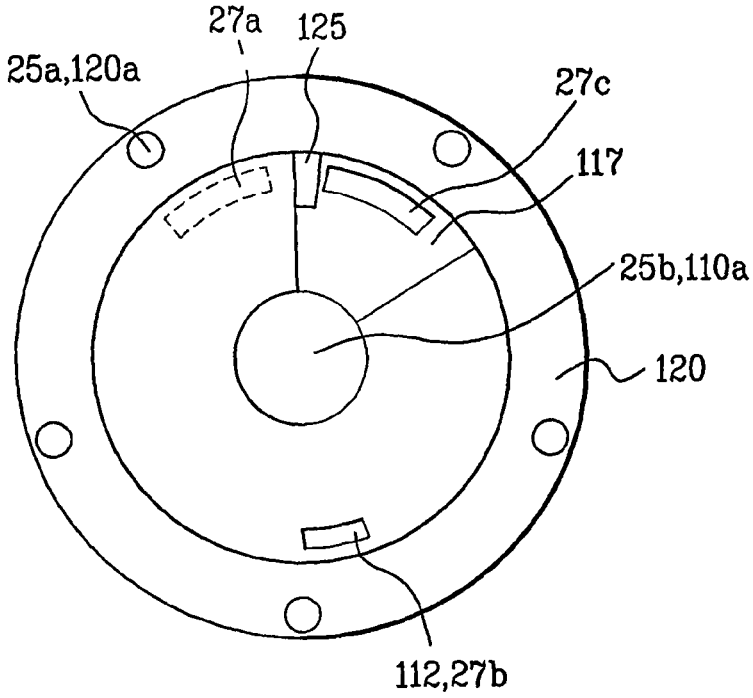

In addition, as shown in FIGS. 11A and 11B, the control means can be provided with a projection 125 formed on the second valve 120 and projecting toward a center of the second valve 120, and a cut-away portion 117 formed on the first valve 110 and receiving the projection 125 movably. In such a control means, a gap between the projection 125 and the cut-away portion 117 can open the first and second suction ports 27*a* and 27*b* by forming the cut-away portion 117 largely in a properly large size. Accordingly, the control means decreases substantially in volume since the grooves of the above-described control means are omitted.

In more detail, as shown in FIG. 11A, if the driving shaft 13 rotates counterclockwise, one end of the projection 125 contacts one end of the cut-away portion 17. Accordingly, a gap between the other ends of the projection 125 and the cut-away portion 117 opens the first suction port 27*a*. In addition, as shown in FIG. 11B, if the driving shaft 13 rotates clockwise, the projection 125 is latched to the cut-away portion 117. At this time, the second opening 112 opens the second suction port 27*b*, and simultaneously, the gap between the projection 125 and the cut-away portion 117 opens the third suction port 27*c* as described above. In such a control means, preferably, the projection 125 has an angle $\beta$1 of approximately 10° between both ends thereof and the cut-away portion 117 has an angle $\beta$2 of 30-120° between both ends thereof.

Figure 12:
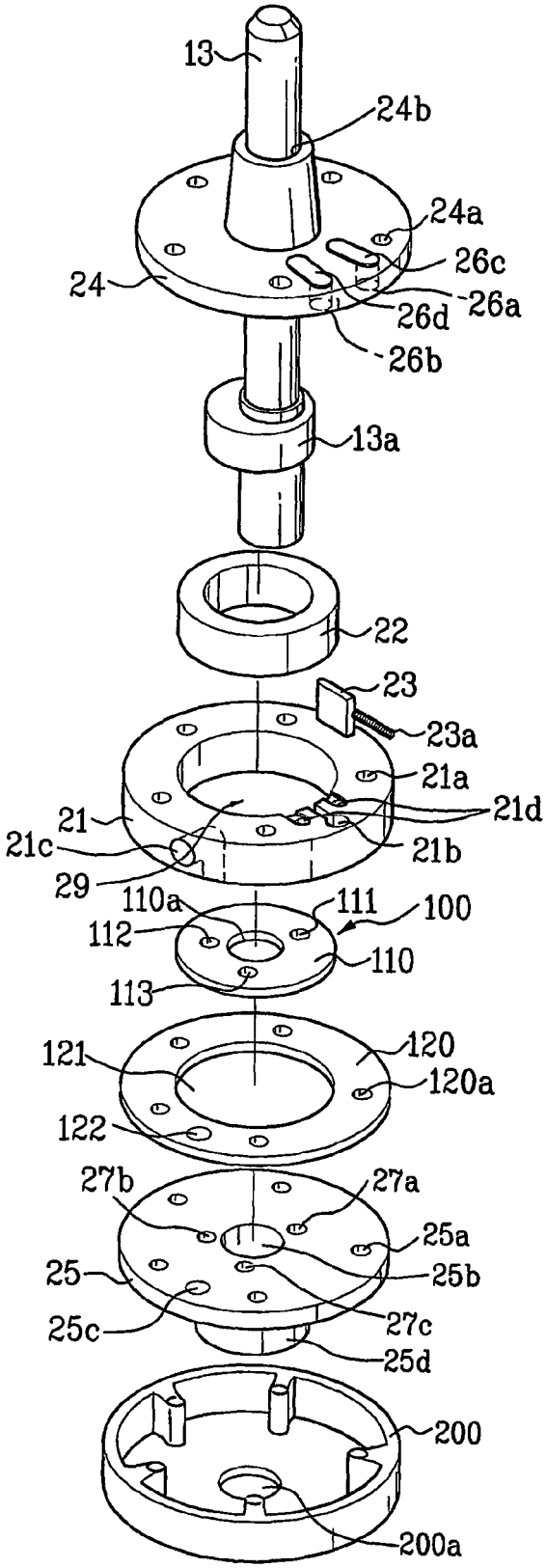
FIG. 12 is an exploded perspective view illustrating a compressing unit of a rotary compressor according to the present invention including a suction plenum.
Figure 13:
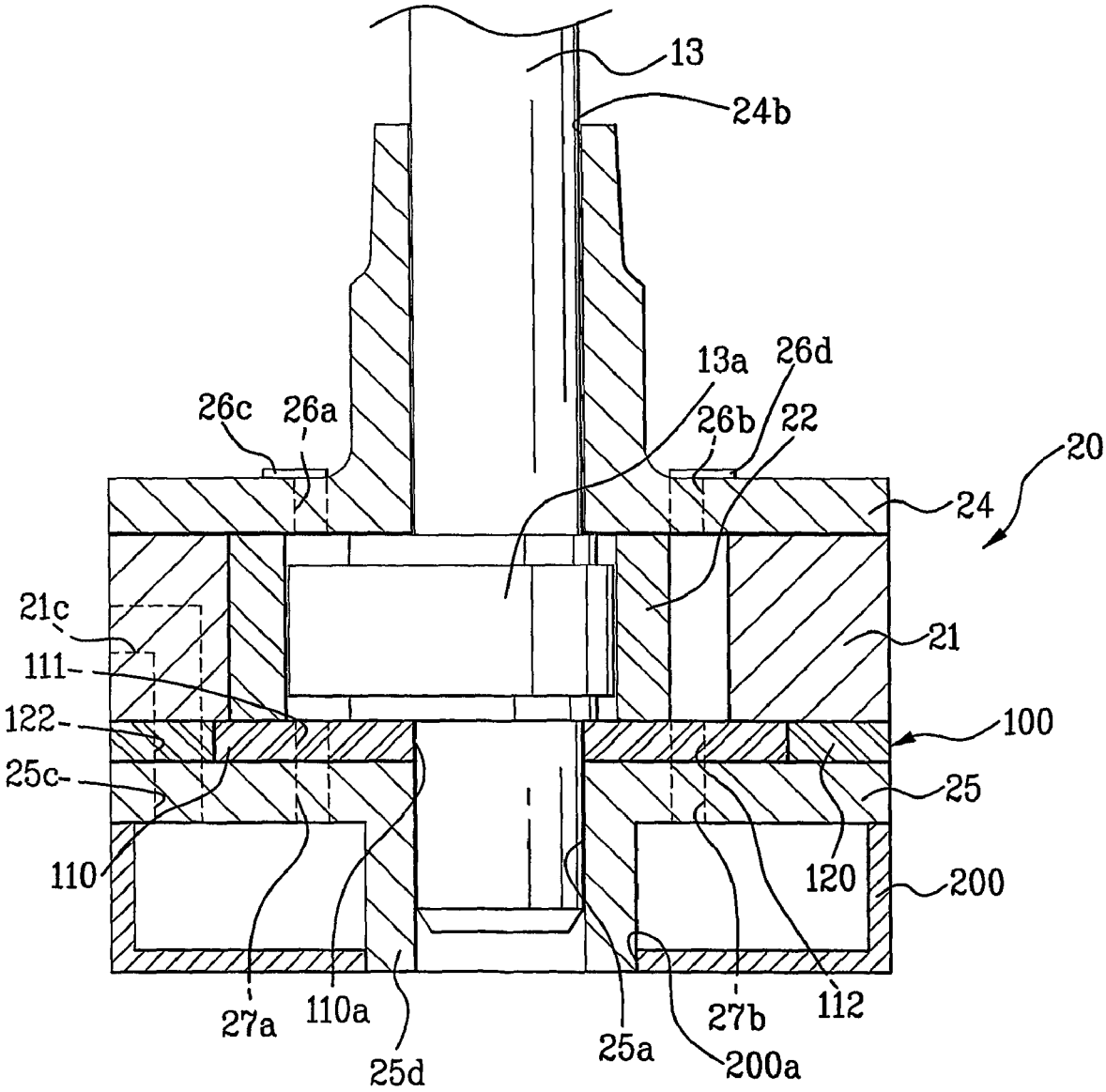
FIG. 13 is a cross-sectional view illustrating a compressing unit shown in FIG. 12.

Meanwhile, as described above with reference to FIG. 2, the suction ports 27*a*, 27*b* and 27*c* are individually connected with a plurality of suction pipes 7*a* so as to supply fluid to the fluid chamber 29 installed inside the cylinder 21. However, the number of parts increases due to these suction pipes 7*a*, thus making the structure complicated. In addition, fluid may not be properly supplied to the cylinder 21 due to a change in a compression state of the suction pipes 7*b* separated during operation. Accordingly, as shown in FIGS. 12 and 13, it is desirable to include a suction plenum 200 for preliminarily storing fluid to be sucked by the compressor.

The suction plenum 200 directly communicates with all of the suction ports 27*a*, 27*b* and 27*c* so as to supply the fluid. Accordingly, the suction plenum 200 is installed in a lower portion of the second bearing 25 in the vicinity of the suction ports 27*a*, 27*b* and 27*c*. Although there is shown in the drawing that the suction ports 27*a*, 27*b* and 27*c* are formed at the second bearing 25, they can be formed at the first bearing 24 if necessary. In this case, the suction plenum 200 is installed in the second bearing 25. The suction plenum 200 can be directly fixed to the bearing 25 by a welding. In addition, a coupling member can be used to couple the suction plenum 200 with the cylinder 21, the first and second bearings 24 and 25 and the valve assembly 100. In order to lubricate the driving shaft 13, a sleeve 25*d* of the second bearing 25 should be soaked into a lubricant which is stored in a lower portion of the case 1. Accordingly, the suction plenum 200 includes a penetration hole 200*a* for the sleeve. Preferably, the suction plenum 200 has one to four times a volume as large as the fluid chamber 29 so as to supply the fluid stably. The suction plenum 200 is also connected with the suction pipe 7 so as to store the fluid. In more detail, the suction plenum 200 can be connected with the suction pipe 7 through a predetermined fluid passage. In this case, as shown in FIG. 12, the fluid passage penetrates the cylinder 21, the valve assembly 100 and the second bearing 25. In other words, the fluid passage includes a suction hole 21*c* of the cylinder 21, a suction hole 122 of the second valve, and a suction hole 25*c* of the second bearing.

Such the suction plenum 200 forms a space in which a predetermined amount of fluid is always stored, so that a compression variation of the sucked fluid is buffered to stably supply the fluid to the suction ports 27*a*, 27*b* and 27*c*. In addition, the suction plenum 200 can accommodate oil extracted from the stored fluid and thus assist or substitute for the accumulator 8.

However, even when this suction plenum 200 is used, since the number of the components does not reduced greatly, the production cost is increased and the productivity can be reduced. On this reason, one second bearing 300 including the functions of the suction plenum 200 is preferably substituted for the suction plenum 200. The second bearing 300 is configured to support the driving shaft rotatably and preliminarily store the fluid to be sucked. Referring to associated drawings, the second bearing 300 will be described in more detail.

Figure 14:
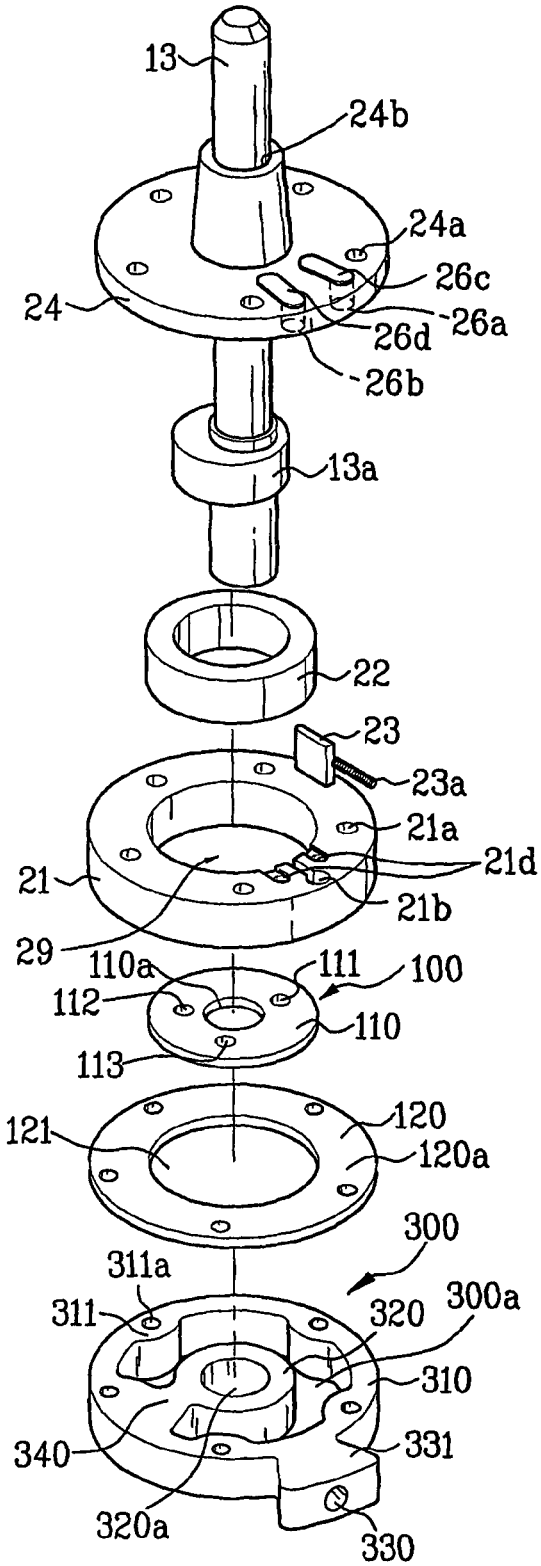
FIG. 14 is an exploded perspective view illustrating a compressing unit of a rotary compressor according to the present invention including a second bearing.
Figure 15:
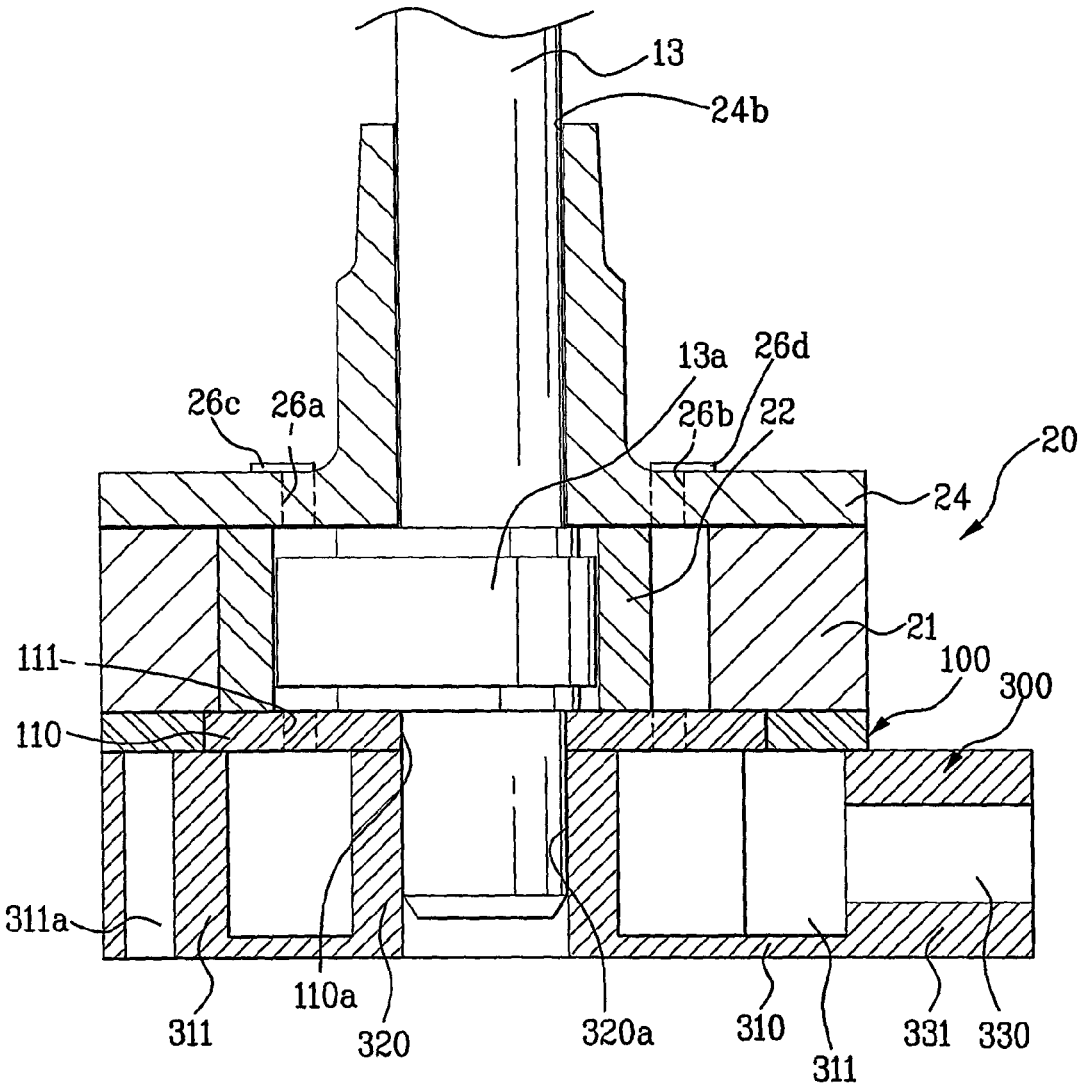
FIG. 15 is a cross-sectional view illustrating the compressing unit shown in FIG. 14.
Figure 16:
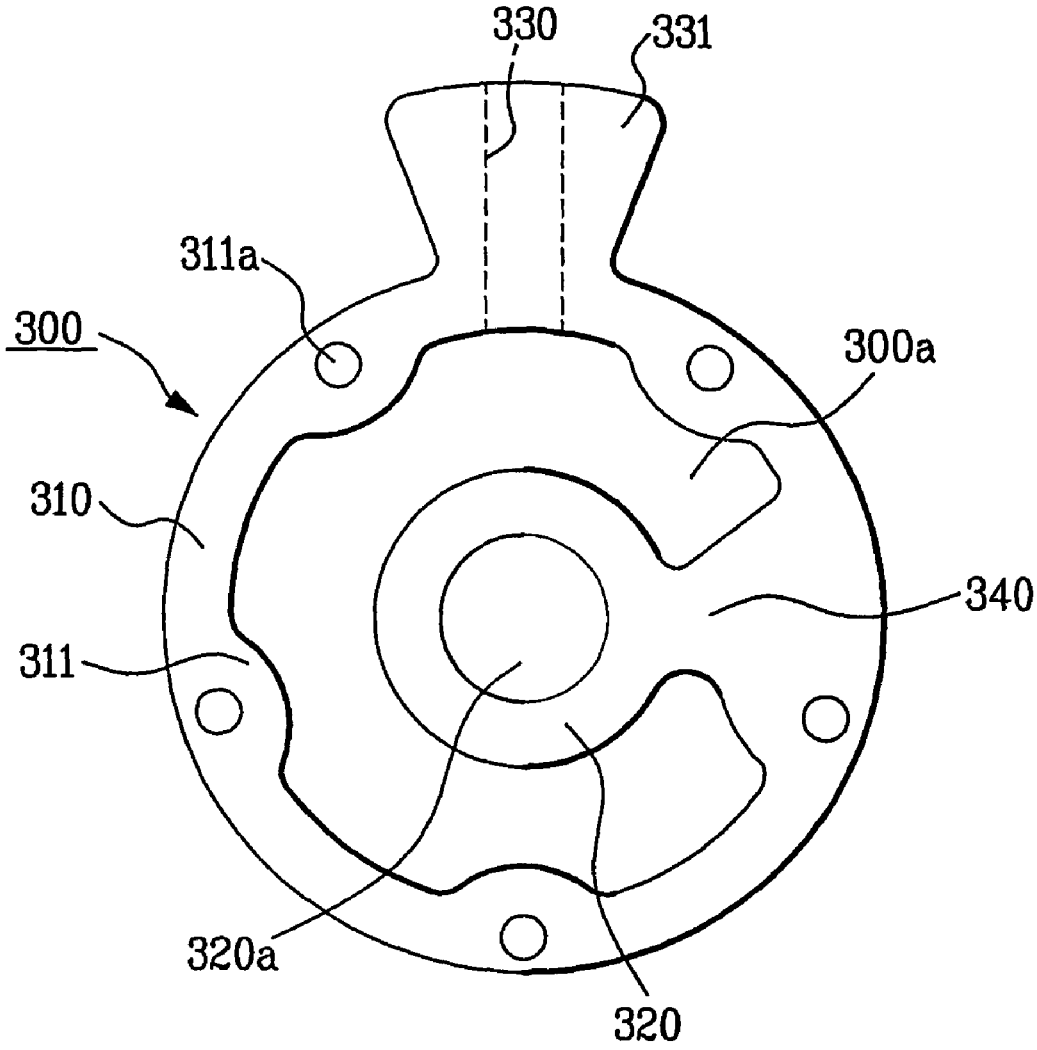
FIG. 16 is a plan view illustrating the second bearing shown in FIGS. 14 and 15.

FIGS. 14 and 15 are an exploded perspective view and a cross-sectional view illustrating a compressing unit of a rotary compressor including a second bearing. FIG. 16 is a plan view of the second bearing.

As shown in the drawings, the second bearing 300 includes a body 310 and a sleeve 320 formed inside the body 310. The body 310 is a container that has a predetermined inner space to store the fluid. The inner space has preferably 100-400% a volume as large as the fluid chamber 29 so as to stably supply the fluid like the suction plenum 200. While the fluid is stored, a lubricant is divided from the fluid. It is accommodated in the inner space, more particularly, the bottom surface of the body 310. In addition, as described above, since the upper portion of the body 310 is opened, one opening 300*a* is formed actually and also roles the function of the flowing passage to supply the fluid of the discharge ports 27*a*, 27*b* and 27*c*. In other words, the second bearing 300 is formed on the upper portion of the body 310 and has one suction port 300*a* communicating continuously with the openings 111 and 112 of the valve assembly. The sleeve 320 supports the driving shaft 13 rotatably. In other words, the driving shaft 13 is inserted into a penetration hole 320*a* formed in thee sleeve 320.

The valve assembly 100 should be supported by a predetermined member so that especially the first valve 110 can rotate with the driving shaft 13. In the embodiment shown in FIGS. 1 through 13, the second bearing 25 supports the first valve 110. Accordingly, the modified second bearing 300 also includes a supporting unit for supporting the valve assembly 100. In the second bearing 300, the end of the sleeve 320 (that is, free end) supports the first valve 110 as shown in FIG. 15. More particularly, the sleeve 320 extends to contact the surface of the lower portion and supports the center area, that is, the peripheral portion of the penetration hole 110*a* relatively. In addition, a plurality of bosses 311 supports the first valve 110. The bosses 311 are formed to make a coupling hole 311*a* basically. The second bearing 300 can be coupled with the valve assembly 100, the cylinder 21 and the first bearing 21 by using the coupling hole 311*a* and a coupling member. The bosses 311 are formed with a predetermined distance on the wall surface of the body, more particularly, on the inner circumference of the body 310 and accordingly the outer circumference of the first valve 110 is supported uniformly. In the preceding embodiment, since the entire surface of the lower portion of the first value 110 is supported by the second bearing 25, the contact area of them is large virtually. Accordingly, when the discharge ports 27*a*, 27*b*, 27*c* are selectively opened, the first valve 110 may not rotate smoothly. However, in the modified second bearing 300, the first valve 110 is partially supported by the sleeve 320 and the bosses 311 so that the contact area can be minimized. On the other hand, if the first valve rotates unstably due to this minimal supporting, the sleeve 320 and the bosses 311 can be thicker properly.

Figure 17A:
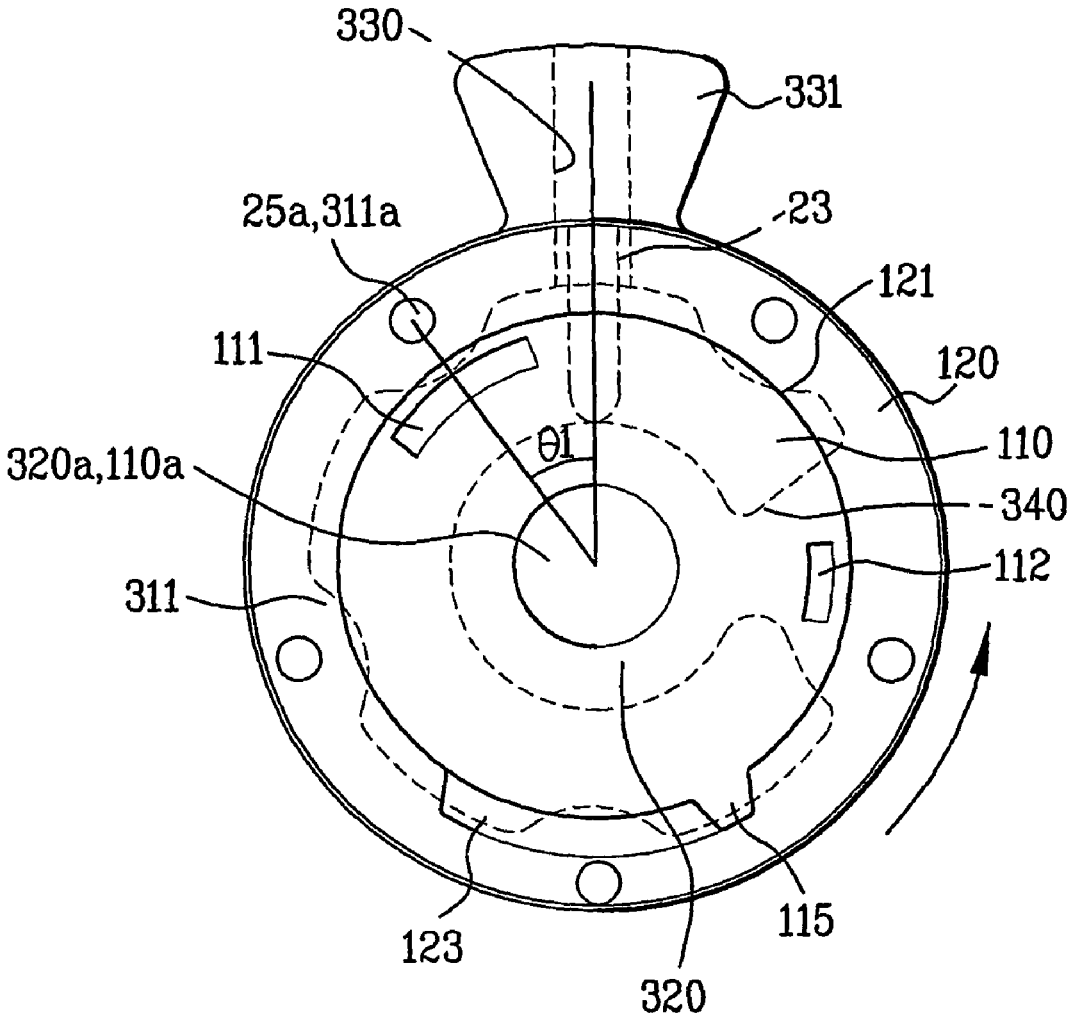
FIGS. 17A and 17B are plan views illustrating an example of a control means of a valve assembly used with a modified second bearing.
Figure 17B:
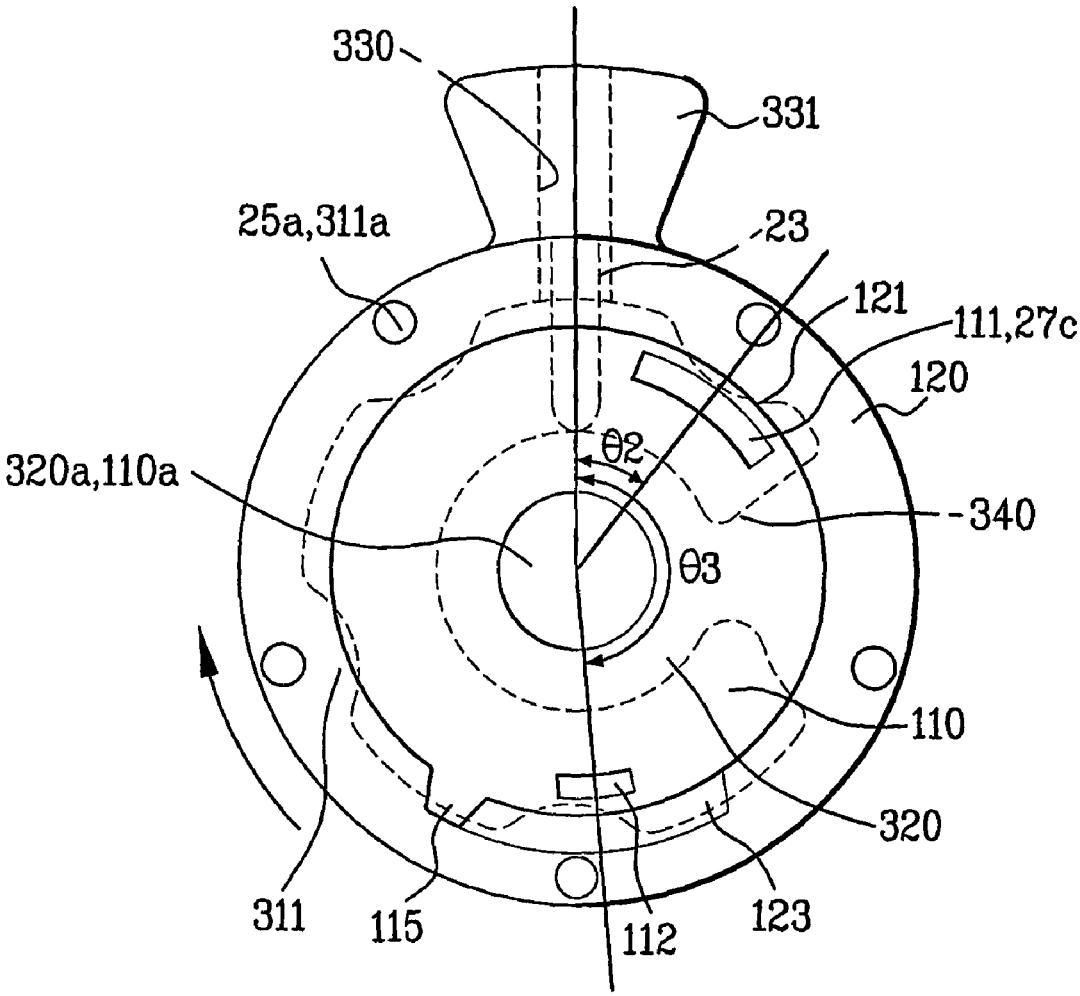

In the preceding embodiment, since the suction passage is formed of the cylinder 21, the valve assembly 100 and the second bearing 25, it is longer actually and the suction efficiency can be reduced. Instead of the suction passage, the second bearing 300 can have a suction inlet 330 connected directly to a suction pipe 7. Accordingly, the suction passage results in being simplified actually and shorter. Generally, the temperature of the inside of the compressor is high and the second bearing 300 is contacted with the hot lubricant stored on the bottom surface of the compressor. If the fluid stays in the second bearing long, it expands due to the hot environment. Accordingly, the fluid sucked into the cylinder 21 has less mass per a predetermined volume. In other words, the mass flowing amount of the fluid is reduced greatly and the compression efficiency is reduced. On this reason, the suction inlet 330 is preferably positioned in the vicinity of the vane 23 as shown in FIGS. 17A and 17B. In other words, the suction inlet 330 is positioned right under the vane 23. Accordingly, the fluid guided into the second bearing 330 through the suction inlet 330 is sucked into the cylinder 21 through the first opening 111 and the expansion of the fluid due to the hot environment is prevented. More preferably, the coupling 311 for fixing the suction pipe 7 is formed around the suction inlet 330. The coupling 311 extends surrounding the suction pipe 7 from the outer circumference of the second bearing 300 and accordingly the suction pipe 7 can be fixed on the second bearing 300 firmly.

Using the modified second bearing 300, the fluid chamber 29 communicates with the inner space of the second bearing 300 through the valve assembly 100 (that is, the first valve 110) without the first and second suction ports 27*a* and 27*b*. In the preceding embodiments, the suction ports 27*a* and 27*b* not only guides the fluid into the cylinder 21 (fluid chamber 29) but also determines a proper suction position for double compression capacity according to the rotation direction of the driving shaft 13. As described above, since the opening 300*a* of the second bearing 300 partially guides the fluid, the valve assembly 100 should the suction position instead of the suction ports 27*a* and 27*b*. More particularly, the openings 111 and 112 of the first valve 110 should communicate with the second bearing 300 through its opening 300*a* at the same position as the location of the suction ports 27*a* and 27*b* that are selectively opened according to rotation direction in the preceding embodiment. As a result, the openings 111 and 112 of the first valve 110 selectively communicate with the second bearing 300 at the same position as the location of the suction ports according to the rotation direction. Here, the position of the suction ports 27*a* and 27*b*, that is, the open location of the openings 111 and 112 is as the same as described above referring to FIG. 4. The characteristics (the position and the number) of the discharging ports 26*a* and 26*b* are also the same as the preceding embodiments. Similarly, the structure of the valve assembly is the same but the function of it differs due to the second bearing 300. This valve assembly will be described referring to FIGS. 4, 17A and 17B. FIG. 17A illustrates the state that the first valve 110 rotates along with the driving shaft counterclockwise. FIG. 17B illustrates the state that the first valve 110 rotates along with the driving shaft clockwise.

As illustrated in FIGS. 17A and 17B, even when the second bearing 300 is used, the valve assembly 100 includes a first valve 110 and a second valve 120 installed between the cylinder 21 and the second bearing 300.

First, the first valve 110 is a disk member installed to contact the eccentric portion 13*a* and rotate in the rotation direction of the driving shaft 13. The first valve 110 includes a first opening 111 and a second opening 112 communicating with the fluid chamber 29 and the second bearing 300 only in a specific rotation direction of the driving shaft 13 as described above. The openings 111 and 112 should be positioned properly to compress the fluid between the discharge ports 26*a* and 26*b* and the roller 22. The fluid is actually compressed from an opening to a discharge port positioned in the revolution path of the roller 22. In other words, two compression capacity can be obtained using openings communicating with the fluid chamber 29 in different locations according to rotation direction. Accordingly, these openings 111 and 112 are separated by a predetermined angle from each other to communicate with both of the fluid chamber 29 and the second bearing 300 at the different locations.

The first opening 111 communicates with the second bearing 300 due to the rotary motion of the first valve 110 when the driving shaft 13 rotates in one direction (counterclockwise as illustrated in FIG. 17A). The second opening 112 communicates with the second bearing 300 due to the rotary motion of the first valve 110 when the driving shaft 13 rotates in the other direction (clockwise as illustrated in FIG. 17A).

More particularly, the first opening 111 communicates with the second bearing 300 in the vicinity of the vane 23 when the driving shaft 13 rotates in one direction (counterclockwise as illustrated in FIG. 17A). Accordingly, the roller 22 compresses the fluid from the first opening 111 to the second discharge port 26*b* positioned across the vane 23 when rotating in one direction. The roller 22 compresses the fluid due to the first suction port 27*a* by using the chamber 29 and accordingly the compressor has the maximum compression capacity at rotary motion in one direction (counterclockwise). In other words, the fluid as much as the overall chamber volume is compressed. The communicating first opening 111 is separated by an angle θ1 of 10° clockwise or counterclockwise from the vane 23 in rotary motion in one direction as the first suction port 27*a* illustrated in FIG. 4. FIG. 17A illustrates the first opening 111 separated by the angle θ1 counterclockwise.

The second opening 112 is separated by a predetermined angle from the vane 23 and communicates with the second bearing 300 when the driving shaft 13 rotates in the other direction (clockwise as illustrated in FIG. 17B). The roller 22 compresses the fluid from the second opening 112 to the first discharge port 26*a* when rotating clockwise. Since the second opening 112 is separated by a considerable angle clockwise from the vane 23, the roller 22 compresses the fluid by using a portion of the chamber 29 and accordingly the compressor has the less compression capacity than that of counterclockwise rotary motion. In other words, the fluid as much as a portion volume of the chamber 29 is compressed. Preferably, the communicating second opening 112 is separated by an angle θ2 in a range of 90-180° clockwise or counterclockwise from the vane 23 as the second suction port 27*b* illustrated in FIG. 4 when the driving shaft 13 rotates in the other direction. FIG. 17B illustrates the second opening 112 separated by the angle θ2 clockwise. The second opening 112 preferably communicates with the second bearing 300 at the position facing the first opening 111 so that the difference between compression capacities can be made properly and the interference can be avoid for each rotation direction.

When the driving shaft 13 rotates clockwise, in other words, when the second opening communicates with the second bearing 300, a vacuum region V is made as illustrated in FIG. 4 while the roller revolves from the vane 23 to the communicating second opening 112. Accordingly, to remove the vacuum region, a third opening 113 communicating with the second bearing 300 is preferably formed at the same position of a third suction port 27*c* of FIG. 4. This third opening 113 is the same as illustrated in FIG. 6. The third opening 113 communicates with the second bearing 300 between the second opening 112 and the vane 23. Accordingly, the third opening 113 supplies the fluid to the space between the roller 22 and the vane 23 in order to prevent the vacuum from being created before the roller passes the second opening 112. Since this third opening 113 works with the second opening 112, the openings 112 and 113 should be opened at the same time while the roller 22 revolves in one direction (clockwise in the drawing). The third opening 113 can be formed separately as illustrated by dotted line in FIG. 6. However, preferably, the rotation angle of the first valve 110 is increased so that the first opening 111 substitutes for the third opening 113 when the driving shaft 13 rotates clockwise as illustrated FIG. 17B. The third opening (the first opening 111 in FIG. 17B) preferably communicates with the second bearing 300 in the vicinity of the vane 23 so that the third opening can remove the vacuum quickly when the driving shaft 13 rotates clockwise. More preferably, since the third opening (the first opening 111 in FIG. 17B) should work with the second opening 112, the third opening is separated by an angle θ3 of 10° clockwise or counterclockwise from the vane to face the communicating position of the first opening 111. Since the first opening 111 communicates in the counterclockwise direction of the vane 23 in FIG. 17A, FIG. 17B illustrates the first opening 111 corresponding to the third opening separated by the angle θ3 clockwise from the vane 23.

Meanwhile, to obtain the desired compression capacity from each rotation direction of the driving shaft, only one opened opening should exist for one rotation direction. If two opening open in revolution path of the roller 22, the fluid is not compressed between the openings. In other words, if the driving shaft 13 rotates counterclockwise and the first opening 111 communicates with the second bearing 300, the second opening 112 should be closed. To achieve this, the second bearing 300 further includes a closing unit 340 configured to close the second opening 112 as illustrated in the drawings. The closing unit 340 is a rib extending between the body 310 and the sleeve 320. The closing unit 340 contacts the lower surface of the first valve 110 around the second opening in order to prevent the fluid from flowing into the second opening 112. Accordingly, the second opening 112 is closed by the closing unit 340 when the first opening 111 communicates due to the rotation of the first valve 110 as shown in FIG. 17A. Here, if the first valve 110 further includes the third opening 113, the third opening 113 should be closed when the first opening opens in the counterclockwise rotation of the driving shaft 13. Accordingly, an additional closing unit for the third opening 113 should be formed on the second bearing 300. If the driving shaft 13 rotates clockwise, the second and third opening 112 and 113 should communicate with the second bearing 300 due to the rotation of the first valve 110 but the first opening 111 should be closed. Accordingly, the second bearing 300 requires another for closing the first opening 111 when the driving shaft rotates clockwise. As a result, the second bearing 300 has a closing unit configured to selectively close the openings 111, 112 and 113 according to the rotation direction of the driving shaft 13. However, as described above, any additional third opening 113 is not formed if the first opening 111 roles the third opening 113. The first opening 111 communicates with the second bearing 300 simultaneously with the second opening 112 when the driving shaft rotates clockwise. In that case, openings for each of the first opening 111 and the third opening 113 are not needed. Accordingly, as shown in FIGS. 17A and 17B, only one closing unit 340 for the second opening 112 is required and it is preferable to simplify the structure of the second bearing 300.

In the first valve 110 described above, to obtain the desired compression capability, it is important that the corresponding openings 111 and 112 are positioned at a predetermined location precisely to communicate with the second bearing 300 for each rotation direction of the driving shaft 13. The rotation angle of the first valve 100 is controlled to obtain the precise communication of the openings 111 and 112. Accordingly, the valve assembly 100 preferably further includes control means for controlling a rotation angle of the first valve. This means is the substantially same as the control means described illustrated in FIGS. 8 and 11. The control means will be described referring to FIGS. 17A and 17B. FIGS. 17A and 17B illustrate a valve assembly 100 coupled with the second bearing 300 to represent the function of the control means.

The control means shown in FIGS. 17A and 17B is the same as the control means shown in FIGS. 9A and 9B. In other words, the control unit includes a projection 115 projecting from the first valve 100 in a radial direction of the first valve 100 and a groove 123 formed on the second valve 220, for receiving the projection 115 movably. When the control means is used and the driving shaft 13 rotates counterclockwise, the projection 115 is caught in an end of the groove 123 as shown in FIG. 17A. Accordingly, the first opening 111 communicates with the second bearing 300 to flow into the cylinder 21 in the vicinity of the vane 23 as described above. The second opening 112 is closed by the closing unit 340. In addition, if the driving shaft 13 rotates clockwise, as shown in FIG. 17B, the projection 115 is caused in the other end of the groove 123. Here, the second opening 112 communicates with the second bearing 300 at the position separated by a predetermined angle form the vane 23. At the same time, the first opening 111 communicates with the second bearing 300 between the vane 23 and the second opening 112. The fluid flows from the second bearing 300 into the cylinder 21 through both the communicating first and second openings 111 and 112. Besides, the control means shown in FIGS. 8A, 8B, 8C, 10A, 10B, 11A and 11B can be adapted to the valve assembly 100 used with the second bearing 300 without changing the control means. However, when the control means shown in FIGS. 11A and 11B are used, the gap between the projection 125 and the cut-away portion 117 communicates with the second bearing 300 instead of the first opening 111. In other words, the gap communicates with the second bearing 300 in the vicinity of the vane 23 when the driving shaft 13 rotates counterclockwise. And also, the gap communicates with the second bearing 300 along with the second opening 112 in the vicinity of the vane 23 when the driving shaft 13 rotates clockwise.

As described above, only the characteristics of the present invention modified by the second bearing 300 are described and the other characteristics not mentioned above was previously described referring to FIGS. 1-13.

Hereinafter, operation of a rotary compressor according to the present invention will be described in more detail.

Figure 18A:
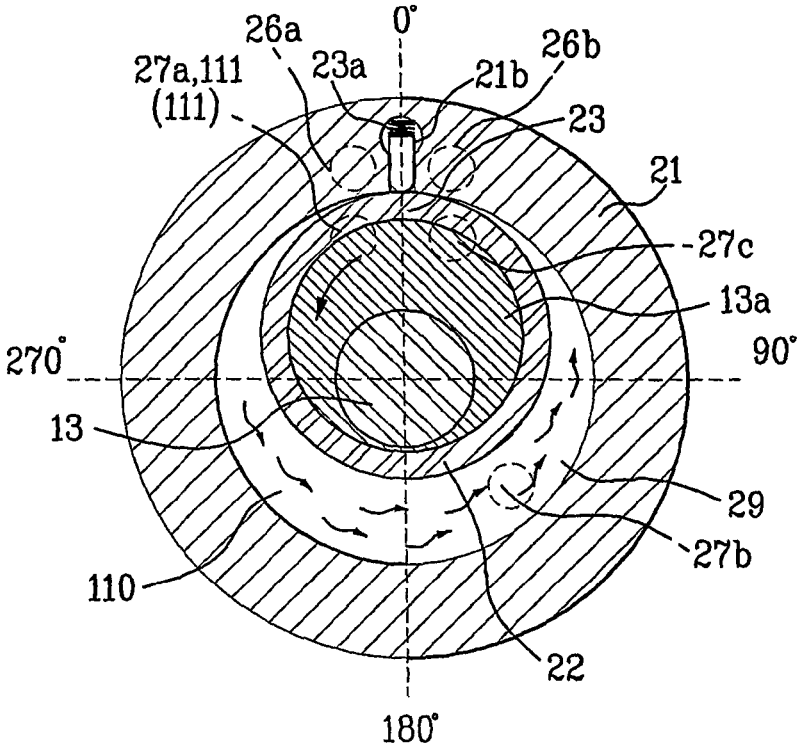
FIGS. 18A and 18C are cross-sectional views illustrating a cylinder sequentially when a roller moves around counterclockwise in a rotary compressor according to the present invention.
Figure 18B:
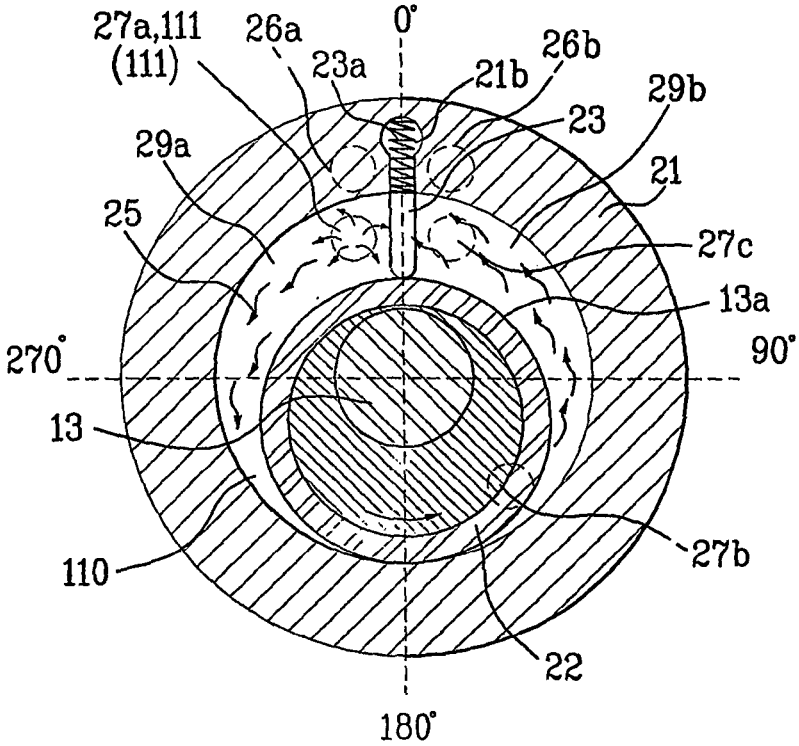
Figure 18C:
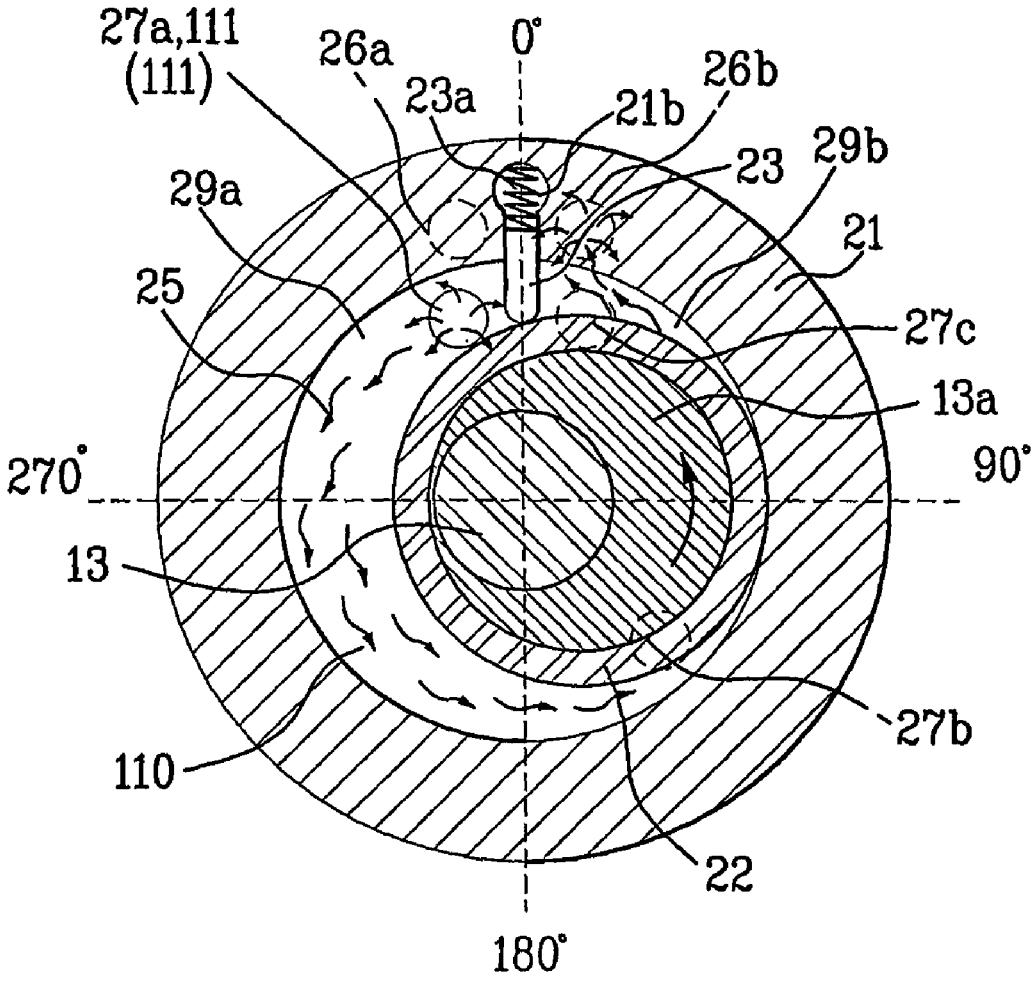

FIGS. 18A to 18C are cross-sectional views illustrating an operation of the rotary compressor when the roller revolves in the counterclockwise direction.

First, in FIG. 18A, there are shown states of respective elements inside the cylinder when the driving shaft 13 rotates in the counterclockwise direction. First, the first suction port 27*a* communicates with the first opening 111, and the remainder second suction port 27*b* and third suction port 27*c* are closed. Detailed description on the state of the suction ports in the counterclockwise direction will be omitted since it has been described with reference to FIGS. 8A, 9A, 10A and 11A. In addition, when the modified second bearing 300 is employed, only the first opening 111 communicates with the second bearing 300 in the vicinity of the vane 23 but the second opening 112 is closed by the closing unit 340. The states of the openings 111 and 112 are as described above referring to FIG. 17A. Since operation of the embodiment in which a separate suction port is provided is substantially similar to that of the embodiment in which the second bearing is provided, the description on them will be omitted for simplification of description. The characteristics of the embodiment in which a suction port is provided and those of the embodiment in which a different second bearing is provided will be additionally denoted in parentheses in drawings and decription.

In a state that the first suction port 27*a* is opened (the state that the first opening 111 is communicated), the roller 22 revolves counterclockwise with performing a rolling motion along the inner circumference of the cylinder due to the rotation of the driving shaft 13. As the roller 22 continues to revolve, the size of the space 29*b* is reduced as shown in FIG. 14B and the fluid that has been sucked is compressed. In this stroke, the vane 23 moves up and down elastically by the elastic member 23*a* to thereby partition the fluid chamber 29 into the two sealed spaces 29*a* and 29*b*. At the same time, new fluid is continuously sucked into the space 29*a* through the first suction port 27 so as to be compressed in a next cycle.

When the fluid pressure in the space 29*b* is above a predetermined value, the second discharge valve 26*d* shown in FIG. 2 is opened. Accordingly, as shown in FIG. 18C, the fluid is discharged through the second discharge port 26*b*. As the roller 22 continues to revolve, all the fluid in the space 29*b* is discharged through the second discharge port 26*b*. After the fluid is completely discharged, the second discharge valve 26*d* closes the second discharge port 26*c* by its self-elasticity.

Thus, after a single cycle is ended, the roller 22 continues to revolve counterclockwise and discharges the fluid by repeating the same cycle. In the counterclockwise cycle, the roller 22 compresses the fluid with revolving from the first suction port 27*a* (the first opening 111) to the second discharge port 26*b*. As aforementioned, since the first suction port 27*a* (the first opening 111) and the second discharge port 27*b* are positioned in the vicinity of the vane 23 to face each other, the fluid is compressed using the overall volume of the fluid chamber 29 in the counterclockwise cycle, so that a maximal compression capacity is obtained.

Figure 19A:
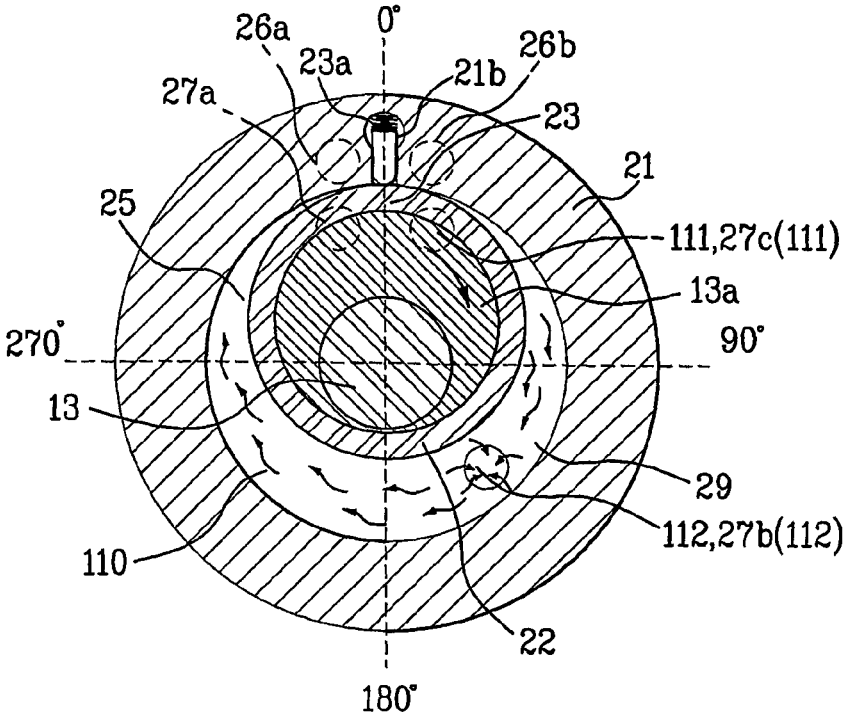
FIGS. 19A and 19C are cross-sectional views illustrating a cylinder sequentially when a roller moves around clockwise in a rotary compressor according to the present invention.
Figure 19B:
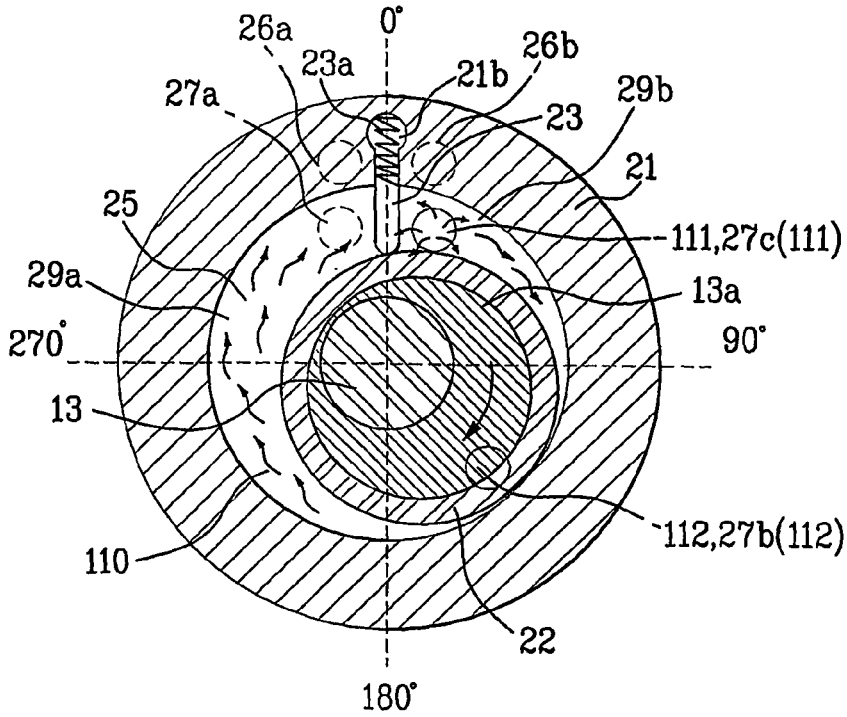
Figure 19C:
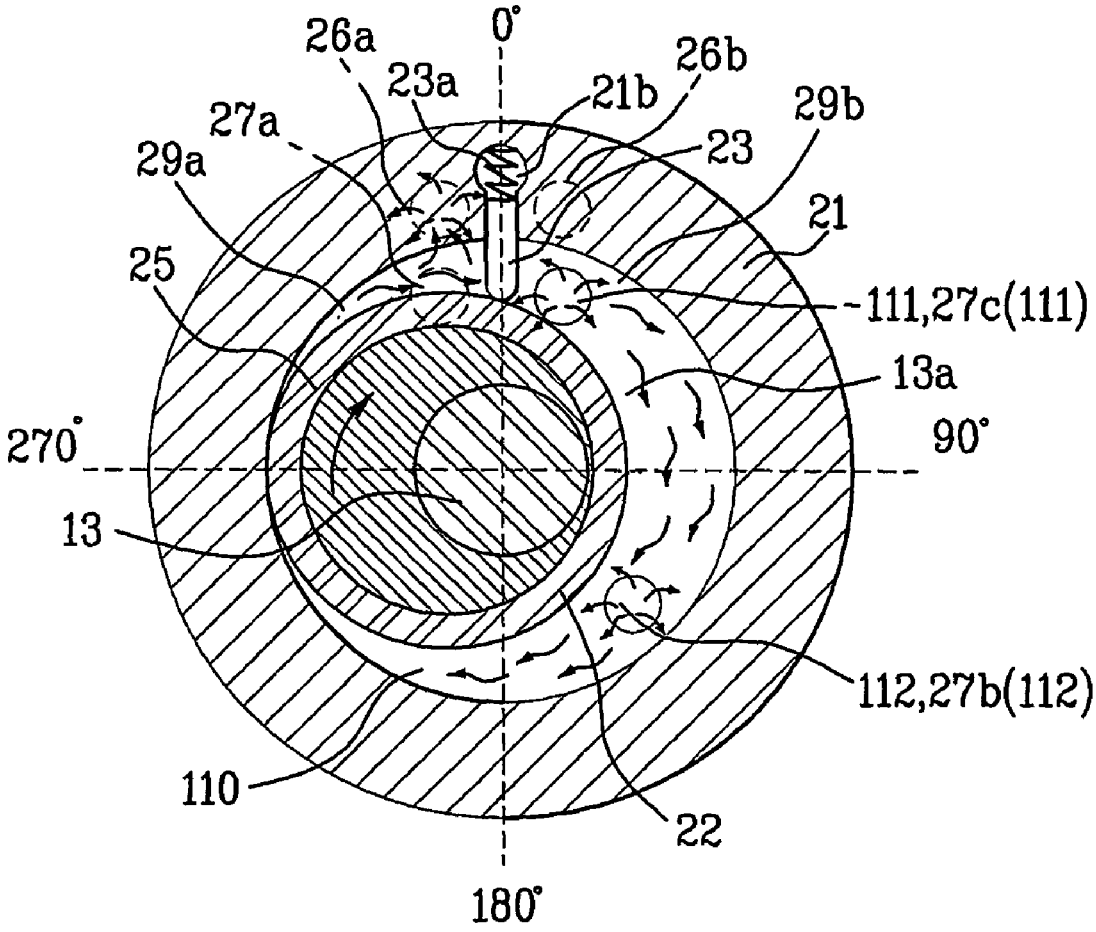

FIGS. 19A to 19C are cross-sectional views an operation sequence of a rotary compressor according to the present invention when the roller revolves clockwise.

First, in FIG. 19A, there are shown states of respective elements inside the cylinder when the driving shaft 13 rotates in the clockwise direction. The first suction port 27*a* is closed, and the second suction port 27*b* and third suction port 27*c* communicate with the second opening 112 and the first opening 111 respectively. If the first valve 110 has the third opening 113 additionally (refer to FIG. 6), the third suction port 27*c* communicates with the third opening 113. Detailed description on the state of the suction ports in the clockwise direction will be omitted since it has been described with reference to FIGS. 8B, 9B, 10B and 11B. @@@ In addition, when the modified second bearing 300 is employed, only the second opening 112 is separated from the vane 23 and the first opening 111 communicates with the second bearing 300 between the vane 23 and the second opening 112. The states of the openings 111 and 112 are as described above referring to FIG. 17B.

In a state that the second and third suction ports 27*b* and 27*c* are opened (the state the first and second openings 111 and 112 are communicated), the roller 22 begins to revolve clockwise with performing a rolling motion along the inner circumference of the cylinder due to the clockwise rotation of the driving shaft 13. In such an initial stage revolution, the fluid sucked until the roller 22 reaches the second suction port 27*b* (the second opening 112) is not compressed but is forcibly exhausted outside the cylinder 21 by the roller 22 through the second suction port 27*b* as shown in FIG. 15A. Accordingly, the fluid begins to be compressed after the roller 22 passes the second suction port 27*b* as shown in FIG. 15B. At the same time, a space between the second suction port 27*b* and the vane 23, i.e., the space 29*b* is made in a vacuum state. However, as aforementioned, as the revolution of the roller 22 starts, the third suction port 27*c* communicates with the first opening 111 (or third opening 113) and thus is opened so as to suck the fluid. On the other hand, when the second bearing 300 is employed, the first opening 111 (or the third opening 113) communicates with the second bearing 300 so as to suck the fluid. Accordingly, the vacuum state of the space 29*b* is removed by the sucked fluid, so that generation of a noise and power loss are constrained.

As the roller 22 continues to revolve, the size of the space 29*a* is reduced and the fluid that has been sucked is compressed. In this compression stroke, the vane 23 moves up and down elastically by the elastic member 23*a* to thereby partition the fluid chamber 29 into the two sealed spaces 29*a* and 29*b*. Also, new fluid is continuously sucked into the space 29*b* through the second and third suction ports 27*b* and 27*c* (the first and second openings 111 and 112) so as to be compressed in a next stroke.

When the fluid pressure in the space 29*a* is above a predetermined value, the first discharge valve 26*c* shown in FIG. 2 is opened and accordingly the fluid is discharged through the first discharge port 26*a*. After the fluid is completely discharged, the first discharge valve 26*c* closes the first discharge port 26*a* by its self-elasticity.

Thus, after a single stroke is ended, the roller 22 continues to revolve clockwise and discharges the fluid by repeating the same stroke. In the counterclockwise stroke, the roller 22 compresses the fluid with revolving from the second suction port 27*b* (the second opening 112) to the first discharge port 26*a* Accordingly, the fluid is compressed using a part of the overall fluid chamber 29 in the counterclockwise stroke, so that a compression capacity smaller than the compression capacity in the clockwise direction.

In the aforementioned strokes (i.e., the clockwise stroke and the counterclockwise stroke), the discharged compressed fluid moves upward through the space between the rotator 12 and the stator 11 inside the case 1 and the space between the stator 11 and the case 1. As a result, the compressed fluid is discharged through the discharge tube 9 out of the compressor.

As described above, the rotary compressor of the present invention can compress the fluid without regard to the rotation directions of the driving shaft and have the compression capacity that is variable according to the rotation directions of the driving shaft. Especially, since the rotary compressor of the present invention have the suction and discharge ports arranged properly and a simple valve assembly for selectively opening the suction ports according to the rotation directions, an overall designed refrigerant chamber can be used to compress the fluid. Furthermore, the rotary compressor of the present invention preliminarily stores the fluid so that the fluid can flow into the cylinder without a separate suction port. The modified bearing that supports the driving shaft rotatably can be adapted.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

The rotary compressor constructed as above has following effects.

First, according to the related art, several devices are combined in order to achieve the dual-capacity compression. For example, an inverter and two compressors having different compression capacities are combined in order to obtain the dual compression capacities. In this case, the structure becomes complicated and the cost increases. However, according to the present invention, the dual-capacity compression can be achieved using only one compressor. Particularly, the present invention can achieve the dual-capacity compression by changing parts of the conventional rotary compressor to the minimum.

Second, the conventional compressor having a single compression capacity cannot provide the compression capacity that is adaptable for various operation conditions of air conditioner or refrigerator. In this case, a power consumption may be wasted unnecessarily. However, the present invention can provide a compression capacity that is adaptable for the operation conditions of equipments.

Third, according to the rotary compressor of the present invention, the conventional designed fluid chamber can be used to provide the dual-compression capacity. It means that the compressor of the present invention has at least the same compression capacity as the conventional rotary compressor having the same cylinder and fluid chamber in size. In other words, the rotary compressor of the present invention can substitute for the conventional rotary compressor without modifying designs of basic parts, such as a size of the cylinder. Accordingly, the rotary compressor of the present invention can be freely applied to required systems without any consideration of the compression capacity and any increase in unit cost of production.

Fourth, according to the present invention, in case of applying the modified bearing, the number of parts of the rotary compressor reduces and productivity increases. The modified bearing can support the valve assembly with the minimum contact area. Accordingly, a force of static friction between the valve assembly and the bearing is remarkably decreased, so that the valve assembly rotates easily along with the driving shaft. Further, the suction passage is substantially shorted since the modified bearing has a suction hole to which the suction pipe is directly connected. As a result, the pressure loss of fluid being sucked is reduced, thereby increasing the compression efficiency. Furthermore, the suction hole is positioned adjacent to the vane for the purpose of being close to the openings of the valve assembly, so that the fluid is promptly introduced into the cylinder through the openings. Accordingly, the compression efficiency is improved much more since the fluid is not expanded under a high temperature environment.

The invention claimed is:

1. A rotary compressor comprising:

a driving shaft being rotatable clockwise and counterclockwise, and having an eccentric portion of a predetermined size;

a cylinder forming a predetermined inner volume;

a roller installed rotatably on an outer circumference of the eccentric portion so as to contact an inner circumference of the cylinder, performing a rolling motion along the inner circumference and forming a fluid chamber to suck and compress fluid along with the inner circumference;

a vane installed elastically in the cylinder to contact the roller continuously;

a first bearing installed in the cylinder, for supporting the driving shaft rotatably;

a second bearing for rotatably supporting the driving shaft and preliminarily storing the fluid to be sucked;

discharge ports communicating with the fluid chamber; and a valve assembly having openings separated by a predetermined angle from each other, for allowing the openings to selectively communicate with the second bearing at a predetermined position of the fluid chamber according to rotation direction of the driving shaft, wherein compression spaces that have different volumes from each other are formed in the fluid chamber according to the rotation direction of the driving shaft so that two different compression capacities are formed.

2. The rotary compressor of claim 1, wherein the roller compresses the fluid using the overall fluid chamber only when the driving shaft rotates in any one of the clockwise direction and the counterclockwise direction.

3. The rotary compressor of claim 1, wherein the roller compresses the fluid using a portion of the fluid chamber when the driving shaft rotates in the other of the clockwise direction and the counterclockwise direction.

4. The rotary compressor of claim 1, wherein the discharge ports comprise a first discharge port and a second discharge port which are positioned facing each other with respect to the vane.

5. The rotary compressor of claim 1, wherein the valve assembly comprises:

a first valve installed rotatably between the cylinder and the bearing; and a second valve for guiding a rotary motion of the first valve.

6. The rotary compressor of claim 5, wherein the first valve comprises a disk member contacting the eccentric portion of the driving shaft and rotating in the rotation direction of the driving shaft.

7. The rotary compressor of claim 6, wherein the first valve has a diameter larger than an inner diameter of the cylinder.

8. The rotary compressor of claim 6, wherein the first valve is 0.5-5 mm thick.

9. The rotary compressor of claim 5, wherein the first valve comprises:

a first opening communicating with the second bearing when the driving shaft rotates in any one of the clockwise direction and the counterclockwise direction; and a second opening communicating with the second bearing when the driving shaft rotates in the other of the clockwise direction and the counterclockwise direction.

10. The rotary compressor of claim 9, wherein the first opening is positioned in the vicinity of the vane when the driving shaft rotates in any one of the clockwise direction and the counterclockwise direction.

11. The rotary compressor of claim 10, wherein the first opening is positioned spaced by approximately 10° from the vane clockwise or counterclockwise.

12. The rotary compressor of claim 9, wherein the second opening is positioned separated from the vane by a predetermined angle when the driving shaft rotates in the other of the clockwise direction and the counterclockwise direction.

13. The rotary compressor of claim 12, wherein the second opening is positioned in a range of 90-180° from the vane to face the first opening.

14. The rotary compressor of claim 9, wherein the first opening and the second opening are circular or polygonal.

15. The rotary compressor of claim 14, wherein the first opening and the second opening have diameters ranged from 6 mm to 15 mm.

16. The rotary compressor of claim 9, wherein the first opening and the second opening are cut-away portions.

17. The rotary compressor of claim 9, wherein the first opening and the second opening are rectangles each having a predetermined curvature.

18. The rotary compressor of claim 9, wherein the first opening and the second opening are positioned in the vicinity of the outer circumference of the first valve.

19. The rotary compressor of claim 9, wherein the first valve further comprises a third opening communicating with the second bearing concurrently with the second opening when the driving shaft rotates in the other of the clockwise direction and the counterclockwise direction.

20. The rotary compressor of claim 19, wherein the third opening is positioned between the second opening and the vane.

21. The rotary compressor of claim 20, wherein the third opening is positioned spaced by approximately 10° from the vane clockwise or counterclockwise.

22. The rotary compressor of claim 5, wherein the first valve comprises a penetration hole into which the driving shaft is inserted.

23. The rotary compressor of claim 5, wherein the second valve is fixed between the cylinder and the bearing and comprises a site portion for receiving the first valve.

24. The rotary compressor of claim 23, wherein the second valve has the same thickness as the first valve.

25. The rotary compressor of claim 5, wherein the valve assembly further comprises control means for controlling a rotation angle of the first valve such that the openings are positioned at selected locations according to rotation directions.

26. The rotary compressor of claim 25, wherein the control means comprises:

a curved groove formed at the first valve and having a predetermined length; and a stopper formed on the bearing and inserted into the curved groove.

27. The rotary compressor of claim 26, wherein the curved groove is positioned in the vicinity of a center of the first valve.

28. The rotary compressor of claim 26, wherein the stopper has the same thickness as the first valve.

29. The rotary compressor of claim 26, wherein the stopper has the same width as the curved groove.

30. The rotary compressor of claim 26, wherein the curved groove has an angle of 30-120° between both ends thereof.

31. The rotary compressor of claim 25, wherein the control means comprises:

a projection formed on the first valve and projecting in a radial direction of the first valve; and a groove formed on the second valve, for receiving the projection movably.

32. The rotary compressor of claim 25, wherein the control means comprises:

a projection formed on the second valve and projecting in a radial direction of the second valve; and a groove formed on the first valve, for receiving the projection movably.

33. The rotary compressor of claim 25, wherein the control means comprises:

a projection formed on the second valve and projecting toward a center of the second valve; and a cut-away portion formed on the first valve, for receiving the projection movably.

34. The rotary compressor of claim 33, wherein the projection and the cut-away portion form a gap therebetween and the gap communicates with the second bearing according to the rotation direction of the driving shaft.

35. The rotary compressor of claim 33, wherein the projection has an angle of 10-90° between both side surfaces.

36. The rotary compressor of claim 33, wherein the cut-away portion has an angle of 30-120° between both ends thereof.

37. The rotary compressor of claim 1, wherein the second bearing comprises:

a body defining a predetermined inner space; and a sleeve for receiving the driving shaft rotatably.

38. The rotary compressor of claim 37, wherein the second bearing has a single opening that is formed on an upper portion of the body and communicates with the openings of the valve assembly.

39. The rotary compressor of claim 37, wherein the inner space has 100-400% a volume as large as the fluid chamber.

40. The rotary compressor of claim 37, wherein the second bearing further comprises a support portion configured to support the valve assembly.

41. The rotary compressor of claim 40, wherein the support portion is comprised of an end of the sleeve configured to support the valve assembly.

42. The rotary compressor of claim 40, wherein the support portion is at least one boss that comprises a connection hole for supporting the valve assembly and coupling the second bearing with the cylinder.

43. The rotary compressor of claim 42, wherein the bosses are formed on a wall of the body.

44. The rotary compressor of claim 37, wherein the second bearing further comprises a suction inlet to which a suction pipe to supply the fluid is connected.

45. The rotary compressor of claim 44, wherein the suction inlet is positioned in the vicinity of the vane.

46. The rotary compressor of claim 44, wherein the suction pipe has a coupling (joint) configured to firmly fix the suction pipe to the suction inlet around the suction pipe.

47. The rotary compressor of claim 37, wherein the second bearing further comprises a closing unit configured to selectively close the openings according to the rotation direction of the driving shaft.

48. The rotary compressor of claim 47, wherein the closing unit selectively closes a second opening of a first valve of the valve assembly.

49. The rotary compressor of claim 47, wherein the closing unit is a rib extending between the body and the sleeve.

50. The rotary compressor of claim 1, wherein the second bearing accommodates oil extracted from the stored fluid.

* * * * *